US011186083B2

(12) United States Patent
Kondo

(10) Patent No.: US 11,186,083 B2
(45) Date of Patent: Nov. 30, 2021

(54) HEAD UNIT AND LIQUID DISCHARGE APPARATUS

(71) Applicant: SEIKO EPSON CORPORATION, Tokyo (JP)

(72) Inventor: Yoichiro Kondo, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/801,627

(22) Filed: Feb. 26, 2020

(65) Prior Publication Data

US 2020/0269580 A1 Aug. 27, 2020

(30) Foreign Application Priority Data

Feb. 27, 2019 (JP) ..... JP2019-033859

(51) Int. Cl.
*B41J 2/14* (2006.01)

(52) U.S. Cl.
CPC ..... *B41J 2/14233* (2013.01)

(58) Field of Classification Search
CPC ..... B41J 2/14233; B41J 2002/14241; B41J 2002/14362; B41J 2002/14419; B41J 2202/08; B41J 2/04593; B41J 2/04588; B41J 2/04581
See application file for complete search history.

(56) References Cited

U.S. PATENT DOCUMENTS

2016/0221337 A1* 8/2016 Sugiura ..... B41J 2/14233

FOREIGN PATENT DOCUMENTS

JP 2018-039174 A 3/2018

OTHER PUBLICATIONS

IP.com search (Year: 2021).*

* cited by examiner

*Primary Examiner* — Lisa Solomon
(74) *Attorney, Agent, or Firm* — Oliff PLC

(57) ABSTRACT

A head unit includes piezoelectric elements configured to be driven in accordance with a drive signal to discharge liquid from nozzles, a protection plate protecting the piezoelectric elements, a head chip including a selection circuit disposed on the protection plate, the selection circuit being configured to select to supply or not to supply the drive signal to the piezoelectric elements, a heat sink, and a thermal conductor coupling the head chip and the heat sink.

8 Claims, 14 Drawing Sheets

HEAD UNIT AND LIQUID DISCHARGE APPARATUS

The present application is based on, and claims priority from JP Application Ser. No. 2019-033859, filed Feb. 27, 2019, the disclosure of which is hereby incorporated by reference herein in its entirety.

BACKGROUND

1. Technical Field

The present disclosure relates a head unit and a liquid discharge apparatus.

2. Related Art

Ink jet printers that include a liquid discharge head for discharging ink in accordance with driving of piezoelectric elements are known. The liquid discharge head described in JP-A-2018-039174 has a drive IC that is disposed on a plate-shaped member for protecting piezoelectric elements.

The arrangement of the drive IC, which is used to select to supply or not to supply a drive signal to each piezoelectric element, disposed on the plate-shaped member allows the high-density nozzles as compared to arrangements in which a drive IC and piezoelectric elements are electrically coupled by using a Chip on Film (COF) or the like. In this arrangement, however, the drive IC and nozzles are close to each other and the heat generated by the drive IC may change the viscosity of ink, resulting in lower print quality.

SUMMARY

According to an aspect of the present disclosure, a head unit includes piezoelectric elements configured to be driven in accordance with a drive signal to discharge liquid from nozzles, a protection plate protecting the piezoelectric elements, a head chip including a selection circuit disposed on the protection plate, the selection circuit being configured to select to supply or not to supply the drive signal to the piezoelectric elements, a heat sink, and a thermal conductor coupling the head chip and the heat sink.

DESCRIPTION OF EXEMPLARY EMBODIMENTS

Figure 1:
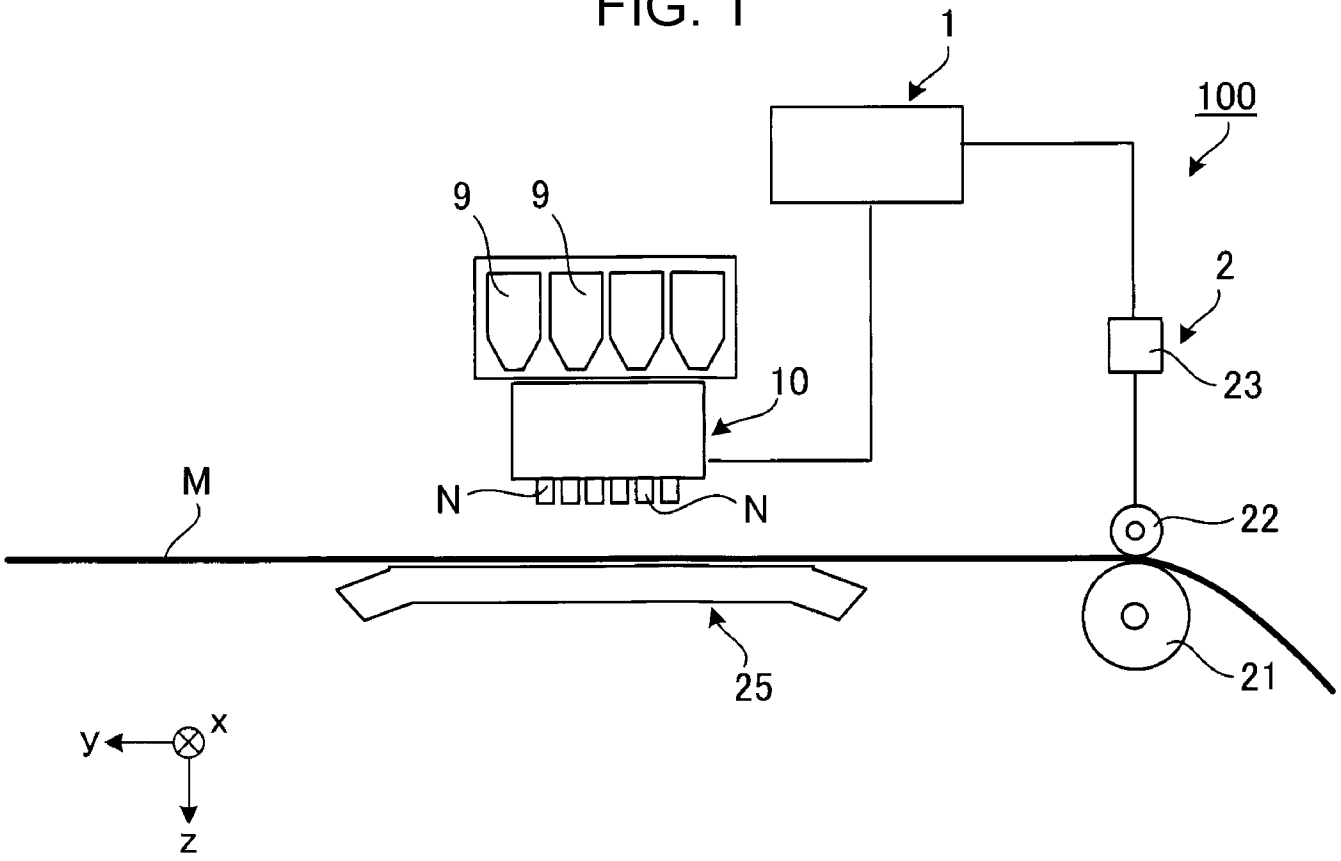
FIG. 1 is a schematic view illustrating a liquid discharge apparatus according to an embodiment.

Hereinafter, an embodiment of the present disclosure will be described in detail with reference to the attached drawings. In the drawings, the dimensions and scale of components may be appropriately changed from actual ones, and may be schematically illustrated to facilitate understanding. It is to be understood that in the following description, the scope of the present disclosure is not limited to the embodiment unless such limitations are explicitly mentioned. "Parallel" as used in this specification is not limited to completely parallel, and two objects may be inclined to each other within a range of plus or minus 5 degrees.

1. Liquid Discharge Apparatus 100

FIG. 1 is a schematic view illustrating a liquid discharge apparatus 100 according to the embodiment. In the description below, for the sake of convenience, an x axis, a y axis, and a z axis illustrated in FIG. 1 that are orthogonal to each other will be used as appropriate. In the description below, a tip side of an arrow that indicates a direction of the axis is referred to as "+ side", and a base end side is referred to as "− side". Furthermore, the direction of the x axis indicated by the arrow is referred to as a +x direction, and the opposite direction is referred to as a −x direction. The same applies to the y axis and the z axis. A +z axis side denotes "upper", and a −z axis side denotes "lower".

A transport direction of a medium M on a platen 25, which will be described below, is parallel to the +y direction. A nozzle array direction along a first array L1 of nozzles N, which will be described below, is parallel to the +y direction. A "discharge direction" in which the nozzles N, which will be described below, discharge ink is parallel to the +z direction. A direction in which head chips 3 of a head unit 10, which will be described below, are arranged, that is, an "arrangement direction" of a first head chip 3*a* and a second head chip 3*b*, which will be described below, is parallel to the +x direction. An "intersecting direction" that intersects the discharge direction is parallel to the +x direction.

The liquid discharge apparatus 100 illustrated in FIG. 1 is an ink jet printer that discharges ink, which is an example "liquid", onto a medium M. The medium M is, for example, printing paper. The medium M may be an object to be printed made of a material such as a resin layer, cloth, or the like. To the liquid discharge apparatus 100, liquid containers 9 for storing ink are attached. The liquid containers 9 each may be a cartridge that is detachably attached to the liquid discharge apparatus 100, a pouch-shaped ink pack made of a flexible film, or an ink tank that can be refilled with ink. The ink may be a black ink or a color ink.

The liquid discharge apparatus 100 includes a control unit 1, a transport mechanism 2, and the head unit 10. The liquid discharge apparatus 100 is a line printer that performs printing with the fixed head unit 10 while transporting a medium M.

The control unit 1 includes, for example, a processing circuit such as a central processing unit (CPU) or a fieldprogrammable gate array (FPGA), and a storage circuit such as a semiconductor memory. The control unit 1 performs overall control of components in the liquid discharge apparatus 100.

The transport mechanism 2 transports a medium M in the +y direction under the control of the control unit 1. The transport mechanism 2 includes a transport roller 21, a following roller 22, and a transporting motor 23. The transporting motor 23 is a drive source for driving the transport roller 21. By the transporting motor 23, the transport roller 21 is rotated. The following roller 22 follows the rotation of the transport roller 21 and rotates. By the rotation of the transport roller 21 and the following roller 22, a medium M is transported on the platen 25, which is disposed on the +z axis side with respect to the head unit 10.

The head unit 10 is a line head that has arrayed nozzles N. The length of the head unit 10 in the +x direction is equal to or longer than the length of a medium M in the +x direction. The head unit 10 discharges ink supplied from the nozzles N toward a medium M under the control of the control unit 1. The discharge of ink by the head unit 10 and the transport of the medium M by the transport mechanism 2 form a desired image on the medium M.

Figure 2:
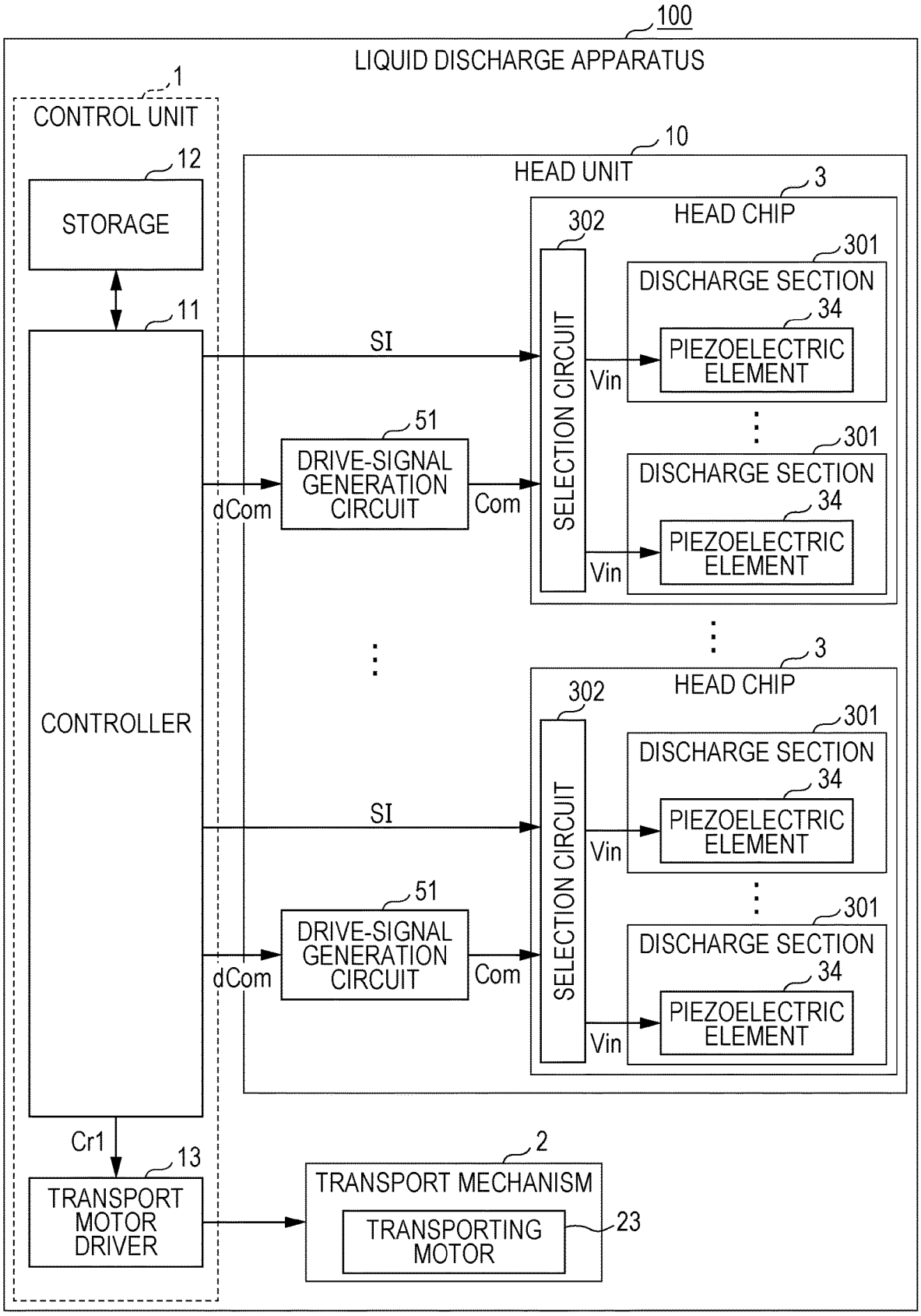
FIG. 2 is a block diagram illustrating a structure of a liquid discharge apparatus according to the embodiment.

FIG. 2 is a block diagram illustrating a structure of the liquid discharge apparatus 100 according to the embodiment. As illustrated in FIG. 2, the control unit 1 includes a controller 11, a storage 12, and a transport motor driver 13. The above-described processing circuit such as a CPU functions as the controller 11. The above-described storage circuit functions as the storage 12.

The controller 11 controls operations of the components in the liquid discharge apparatus 100. To the controller 11, print data is supplied from an external device such as a host computer (not illustrated). The print data is data of an image to be formed by the liquid discharge apparatus 100. Based on the print data, the controller 11 generates various signals for controlling operations of the components in the liquid discharge apparatus 100. The signals include, for example, a transport control signal Cr1, a waveform-designating signal dCom, and a print signal SI.

The transport control signal Cr1 is a signal for controlling the operation of the transport motor driver 13. The waveform-designating signal dCom is a digital voltage signal for designating a waveform of a drive signal Com for driving the head unit 10. The print signal SI is a digital voltage signal for designating whether or not to supply a drive signal Com. The print signal SI is a signal for determining whether or not to discharge ink from each of discharge sections 301 of the head unit 10 and for determining an amount of discharge. The controller 11 receives or generates, other than the print signal SI, various control signals such as a clock signal and a latch signal.

The head unit 10 includes drive-signal generation circuits 51 and head chips 3. The drive-signal generation circuit 51 includes a digital-to-analog (D/A) conversion circuit. The drive-signal generation circuit 51 generates an analog drive signal Com based on a waveform-designating signal dCom. The drive signal Com includes a first drive signal Com-A and a second drive signal Com-B. Each of the first drive signal Com-A and the second drive signal Com-B is an analog voltage signal for driving piezoelectric elements 34 in a head chip 3.

Each head chip 3 includes discharge sections 301 and a selection circuit 302. Each discharge section 301 includes a piezoelectric element 34, which is an example "drive element". The piezoelectric element 34 is driven such that ink is discharged from nozzles N. The selection circuit 302 selects to supply or not to supply a drive signal Com to piezoelectric elements 34 in accordance with a print signal SI, and the like. The selection circuit 302 generates an individual drive signal Vin for driving each of the piezoelectric elements 34 based on various signals such as a drive signal Com and a print signal SI. The selection circuit 302 includes a plurality of sets each including, for example, a shift register, a latch circuit, a decoder, and transmission gates that function as a switch. One set is provided for one piezoelectric element 34. One of two transmission gates correspond to the first drive signal Com-A. The other one corresponds to the second drive signal Com-B.

Figure 3:
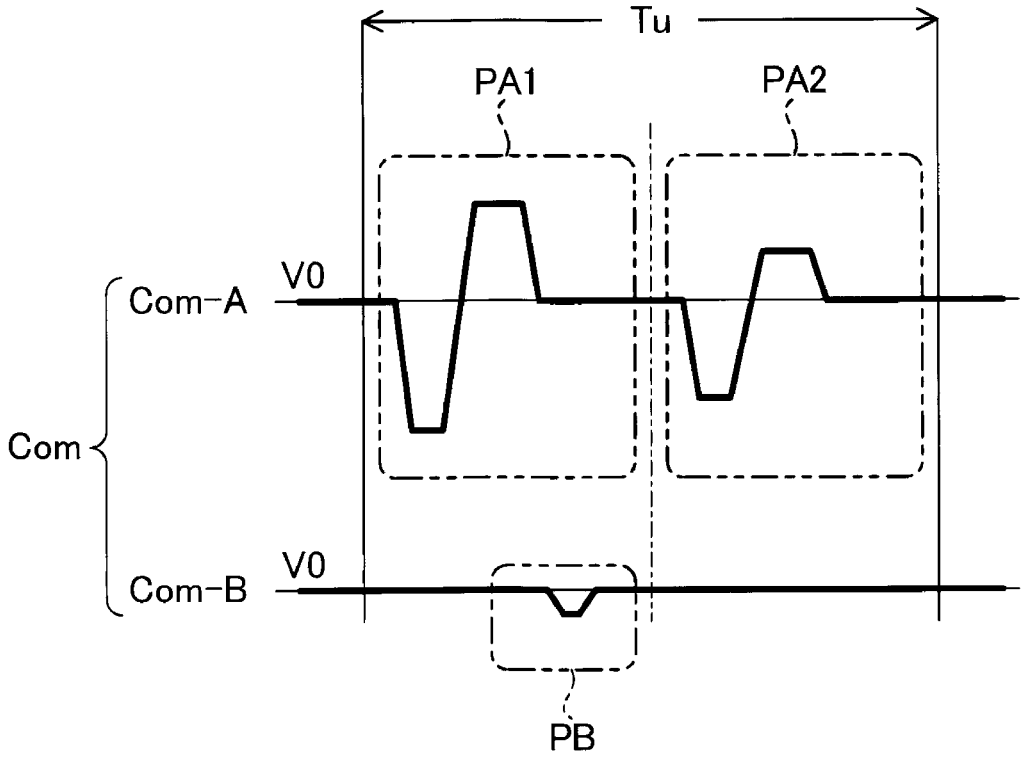
FIG. 3 illustrates waveforms of a first drive signal and a second drive signal according to the embodiment.

FIG. 3 illustrates waveforms of the first drive signal Com-A and the second drive signal Com-B according to the embodiment. As illustrated in FIG. 3, the first drive signal Com-A includes a discharge waveform PA1 and a discharge waveform PA2. The second drive signal Com-B includes a micro-vibration waveform PB. The second drive signal Com-B has a smaller amplitude than that of the first drive signal Com-A. The drive-signal generation circuit 51 supplies the first drive signal Com-A and the second drive signal Com-B to the selection circuit 302 every unit period Tu under the control of the controller 11. The selection circuit 302 supplies the piezoelectric element 34 with an individual drive signal Vin based on one of the first drive signal Com-A and the second drive signal Com-B.

2. Head Unit 10

2-1. Structure of Head Unit 10

Figure 4:
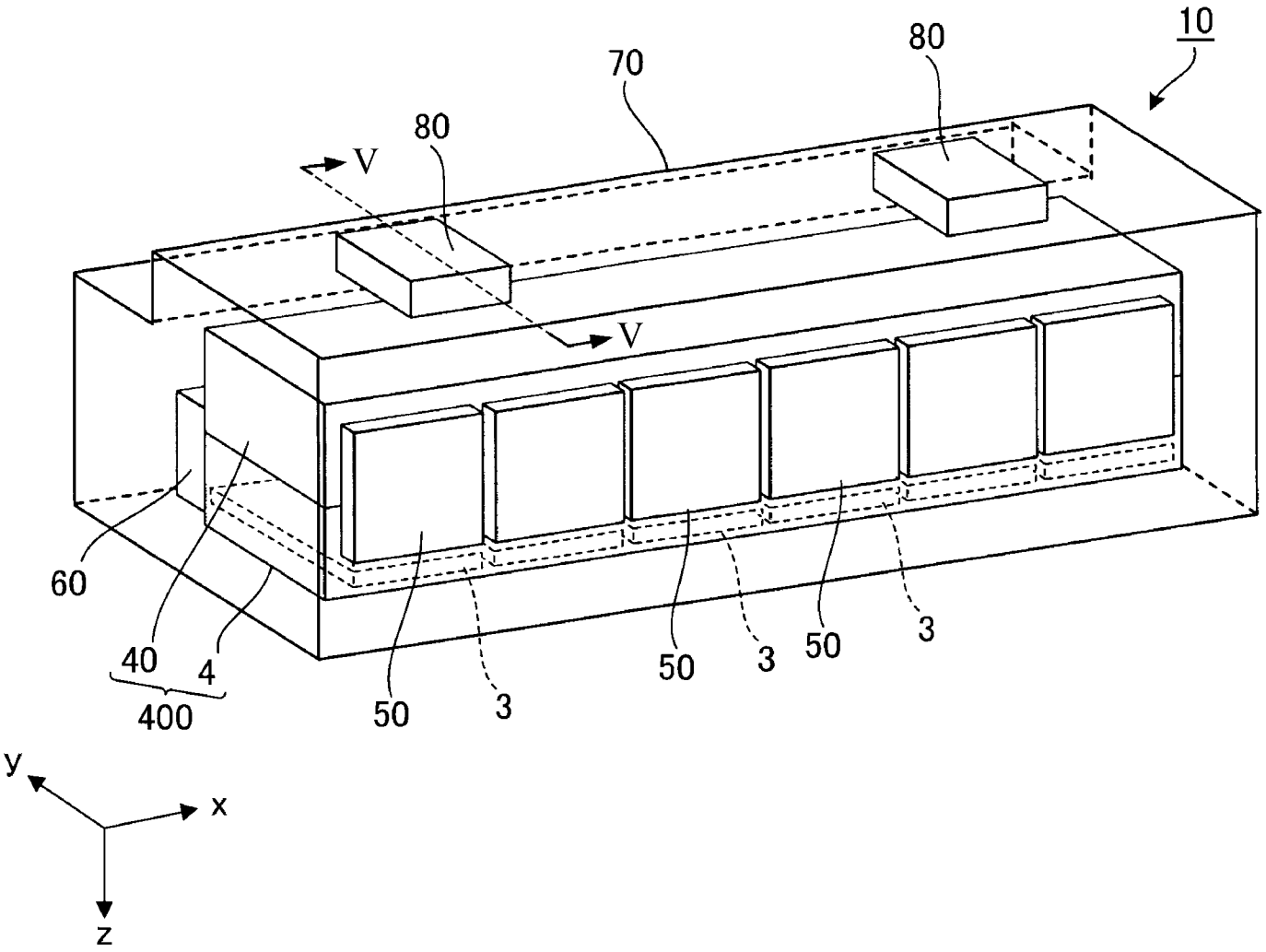
FIG. 4 is a schematic perspective view illustrating a head unit according to the embodiment.

FIG. 4 is a schematic perspective view illustrating the head unit 10 according to the embodiment. As illustrated in FIG. 4, the head unit 10 includes a flow channel unit 400, the head chips 3, circuit boards 50, a heat sink 60, fans 80, and a cover 70. The flow channel unit 400, the head chips 3, the circuit boards 50, and the heat sink 60 are disposed inside the cover 70. The fans 80 are disposed on the −z axis side with respect to the cover 70 and fixed to the cover 70.

Figure 5:
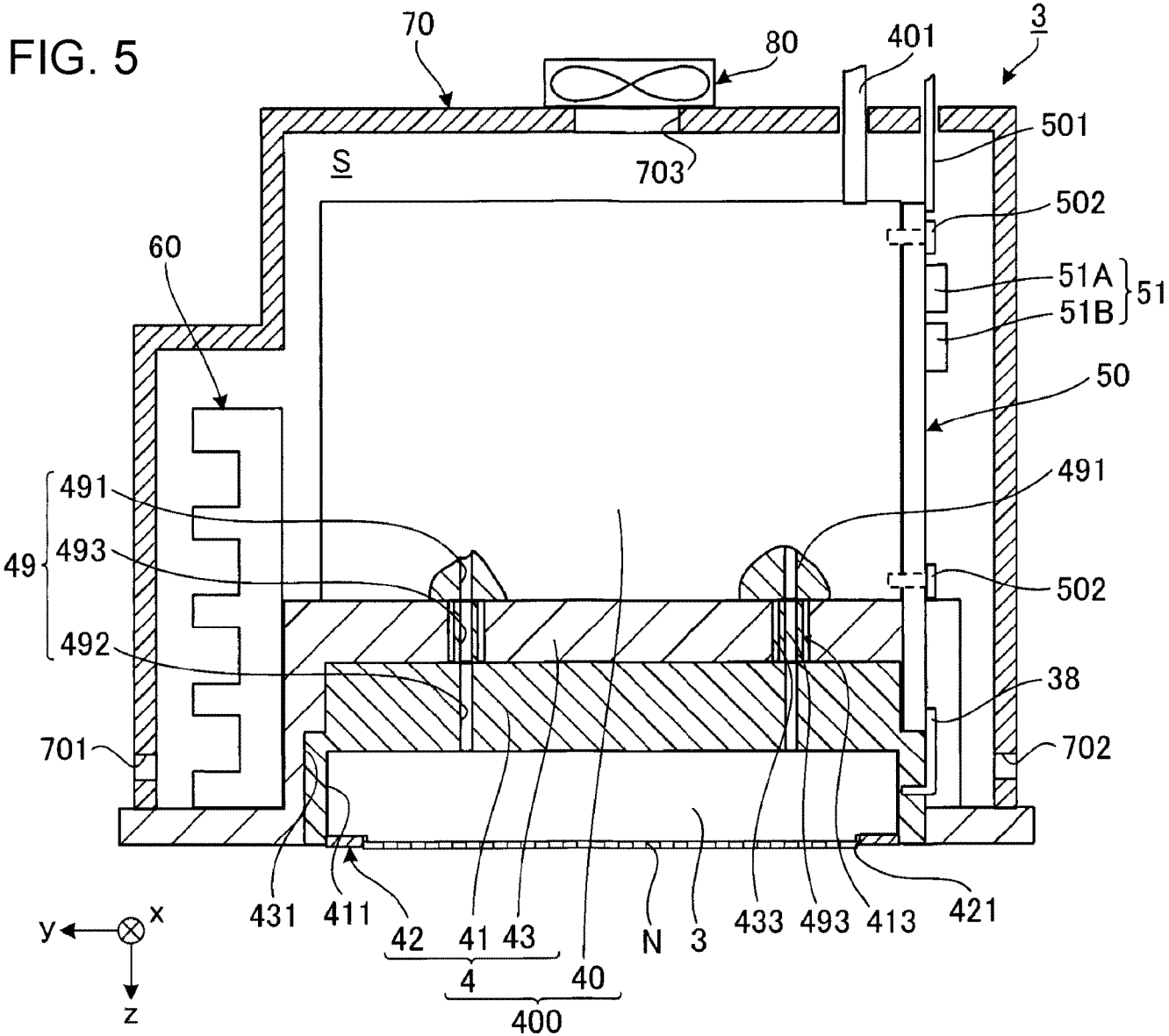
FIG. 5 is a cross-sectional view illustrating a head unit according to the embodiment.
Figure 6:
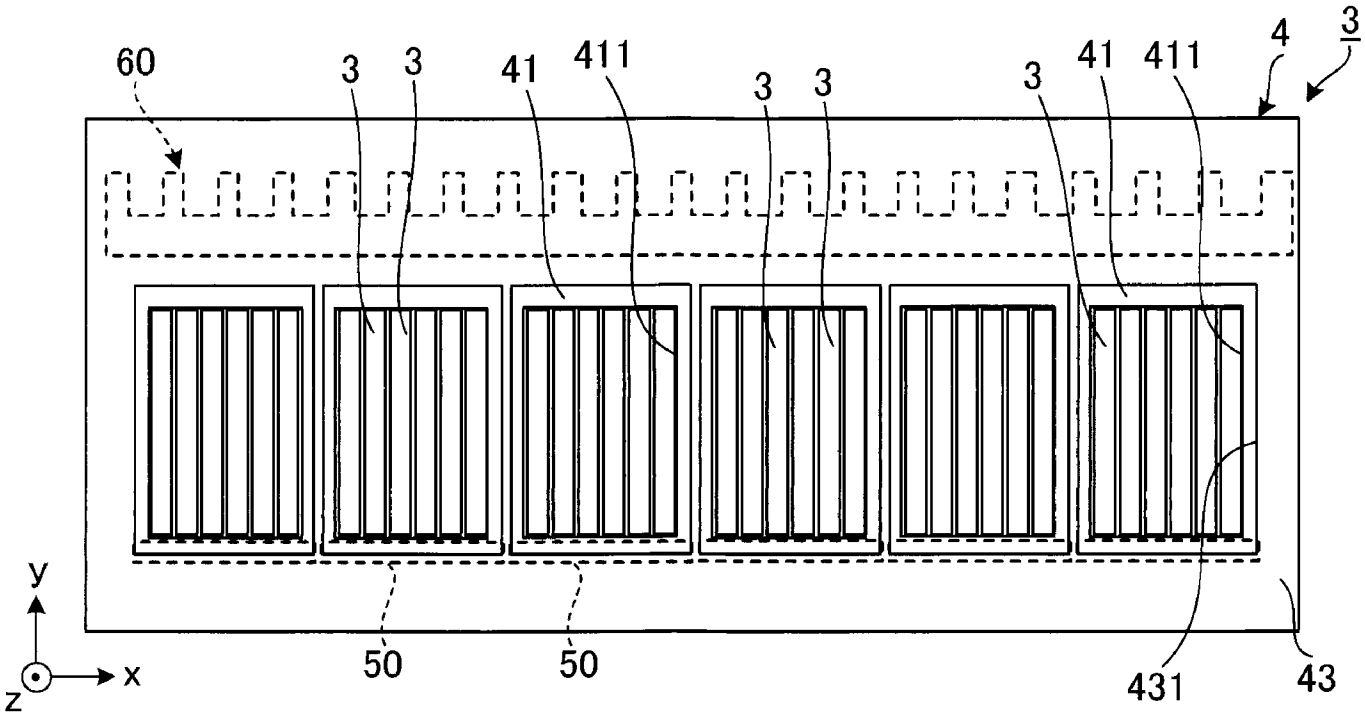
FIG. 6 is a plan view illustrating a head unit according to the embodiment.

FIG. 5 is a cross-sectional view illustrating the head unit 10 according to the embodiment, and is a cross-sectional view taken along line V-V in FIG. 4. FIG. 6 is a plan view illustrating the head unit 10 according to the embodiment viewed from the −z direction. In FIG. 6, a fixing plate 42 is not illustrated.

2-1a. Flow Channel Unit 400

As illustrated in FIG. 5, the flow channel unit 400 includes a flow channel structure 40 and a supporting member 4. The flow channel unit 400 has a liquid flow channel 49 for supplying the ink stored in the liquid container 9 to the head chip 3.

To the flow channel structure 40, an ink supply member 401 such as a tube is coupled. One end of the ink supply member 401 is coupled to the liquid container 9. The flow channel structure 40 has a distribution flow channel 491 for distributing the ink supplied from the liquid container 9 to head chips 3. The distribution flow channel 491 is a part of the liquid flow channel 49. The flow channel structure 40 may have a gas flow channel through which gas such as air flows. The flow channel structure 40 may have a pressure adjustment section that changes the pressure in the distribution flow channel 491 by the air from the gas flow channel.

The supporting member 4 supports the head chips 3. The supporting member 4 includes holders 41, the fixing plates 42, and a base 43. As illustrated in FIG. 6, the head chips 3 are disposed along the +x direction.

Each holder 41 supports a plurality of head chips 3 together. Each holder 41 in this embodiment supports six head chips 3 together. The holders 41 are disposed along the +x direction. The holder 41 has a recessed portion 411 that is open on the +z side. In the recessed portion 411, six head chips 3 are disposed. As illustrated in FIG. 5, the holder 41 has a supply flow channel 492 for supplying ink to each head chip 3. The holder 41 has a plurality of protrusions 413 on a surface on the −z axis side. The protrusion 413 has a communication flow channel 493. The communication flow channel 493 communicates with the distribution flow channel 491 and the supply flow channel 492. The distribution flow channel 491, the supply flow channel 492, and the communication flow channel 493 constitute the liquid flow channel 49.

The fixing plate 42 illustrated in FIG. 5 is a plate-shaped member. One fixing plate 42 is provided for one holder 41. On the fixing plate 42, six head chips 3 are disposed. The fixing plate 42 is fixed to the holder 41, for example, by screwing, and by the fixing plate 42, the head chips 3 are fixed to the holder 41. The fixing plate 42 has an opening 421 that has a long and substantially rectangular shape. One head chip 3 has one opening 421. From the opening 421, the nozzles N of the head chip 3 are exposed.

As illustrated in FIG. 5 and FIG. 6, the base 43 supports together the holders 41. The base 43 in this embodiment supports together the six holders 41. The base 43 has a recessed portion 431 that is open on the +z side. In the recessed portion 431, the holders 41 are disposed. The holders 41 are fixed to the base 43, for example, with an adhesive. As illustrated in FIG. 5, the base 43 has through holes 433. Into one through hole 433, one protrusion 413 is inserted.

The supporting member 4 functions as a "heat transmission member" that transmits heat generated in the head chips 3 to the heat sink 60, which will be described below. The supporting member 4 is made of a material that has high thermal conductivity. The supporting member 4 has higher thermal conductivity than that of air. In particular, the holders 41 and the base 43 have high thermal conductivity. The holders 41 and the base 43 may each be made of a metal material, specifically, aluminum. Aluminum has high thermal conductivity among metal materials. The holders 41 and the base 43 are each formed, for example, by die casting. The fixing plate 42 is made of, for example, a highly rigid metal such as a stainless steel.

The number of the head chips 3 that are supported by one holder 41 is not limited to six, and any number of the head chips 3 may be supported. The number of the holders 41 that are supported by the base 43 is not limited to six, and any number of the holders 41 may be supported.

2-1b. Heat Sink 60

As illustrated in FIG. 5 and FIG. 6, the heat sink 60 is disposed on the +y axis side with respect to the head chip 3. The heat sink 60 is fixed to the base 43, for example, by screwing. The heat sink 60 may be fixed, for example, to the flow channel structure 40.

The heat sink 60 is used to dissipate or absorb heat of the heat chips 3. The heat sink 60 efficiently release heat generated in the head chips 3 to the outside of the head chips 3. The heat sink 60 is made of a material that has high thermal conductivity. The heat sink 60 may be made of a metal material, for example, aluminum. The length of the heat sink 60 along the +x direction is equal to or substantially equal to the length of the base 43 along the +x direction. The length of the heat sink 60 may be shorter or longer than the length of the base 43 along the +x direction.

2-1c. Circuit Board 50

The circuit boards 50 each having a rectangular plate shape are disposed on the −y axis side with respect to the head chips 3. In this embodiment, one circuit board 50 is provided for one holder 41. Accordingly, for six head chips 3, one circuit board 50 is provided. Each circuit board 50 is fixed to the flow channel unit 400 by screwing with a plurality of screws 502. In this embodiment, the circuit boards 50 are fixed to the flow channel structure 40. The circuit boards 50 may be fixed to the base 43.

As illustrated in FIG. 5, the drive-signal generation circuit 51 is disposed on the circuit board 50. The drive-signal generation circuit 51 includes a first drive-signal generation circuit 51A that generates a first drive signal Com-A and a second drive-signal generation circuit 51B that generates a second drive signal Com-B. To the circuit board 50, a wiring board 501 is coupled. The drive-signal generation circuit 51 is electrically coupled to the control unit 1 that is located outside the cover 70 via the wiring board 501. The wiring board 501 is, for example, a flexible wiring board. The circuit board 50 will be described in detail below.

2-1d. Cover 70

As illustrated in FIG. 5, the cover 70 is disposed to cover the head chips 3, the flow channel unit 400, the heat sink 60, and the circuit boards 50 from above. The cover 70 is a cylindrical case that is open on the +z axis side and has a bottom. The cover 70 is fixed to the base 43, for example, by screwing. The cover 70 protects the head chips 3, the flow channel unit 400, the heat sink 60, and the circuit boards 50. The cover 70 has a space S between the head chips 3, the flow channel unit 400, the heat sink 60, and the circuit boards 50.

The cover 70 has a first inlet 701, a second inlet 702, and an outlet 703. In this embodiment, a plurality of the first inlets 701, the second inlets 702, and the outlets 703 are disposed respectively.

The first inlets 701 and the second inlets 702 are example "inlets". The first inlets 701 and the second inlets 702 are holes for drawing air outside the cover 70 into the space S. The first inlets 701 are disposed on the +y axis side with respect to the heat sink 60. The second inlets 702 are disposed on the −y axis side with respect to the circuit board 50. The first inlets 701 and the second inlets 702 are each provided above the nozzles N. The first inlets 701 and the second inlets 702 may each be disposed below the nozzles N; however, the first inlets 701 and the second inlets 702 disposed above can prevent ink discharged from the nozzles from entering the space S.

The outlets 703 are holes for discharging air in the cover 70, that is, the space S to the outside of the cover 70. One outlet 703 is provided for one fan 80. The outlets 703 are provided above the first inlets 701 and the second inlets 702. The outlets 703 are provided above the head chips 3, the flow channel unit 400, the heat sink 60, and the circuit boards 50.

2-1e. Fan 80

As illustrated in FIG. 5, the fan 80 is disposed above the outlet 703. The fan 80 moves the air in the space S from the first inlet 701 and the second inlet 702 toward the outlet 703.

Figure 7:
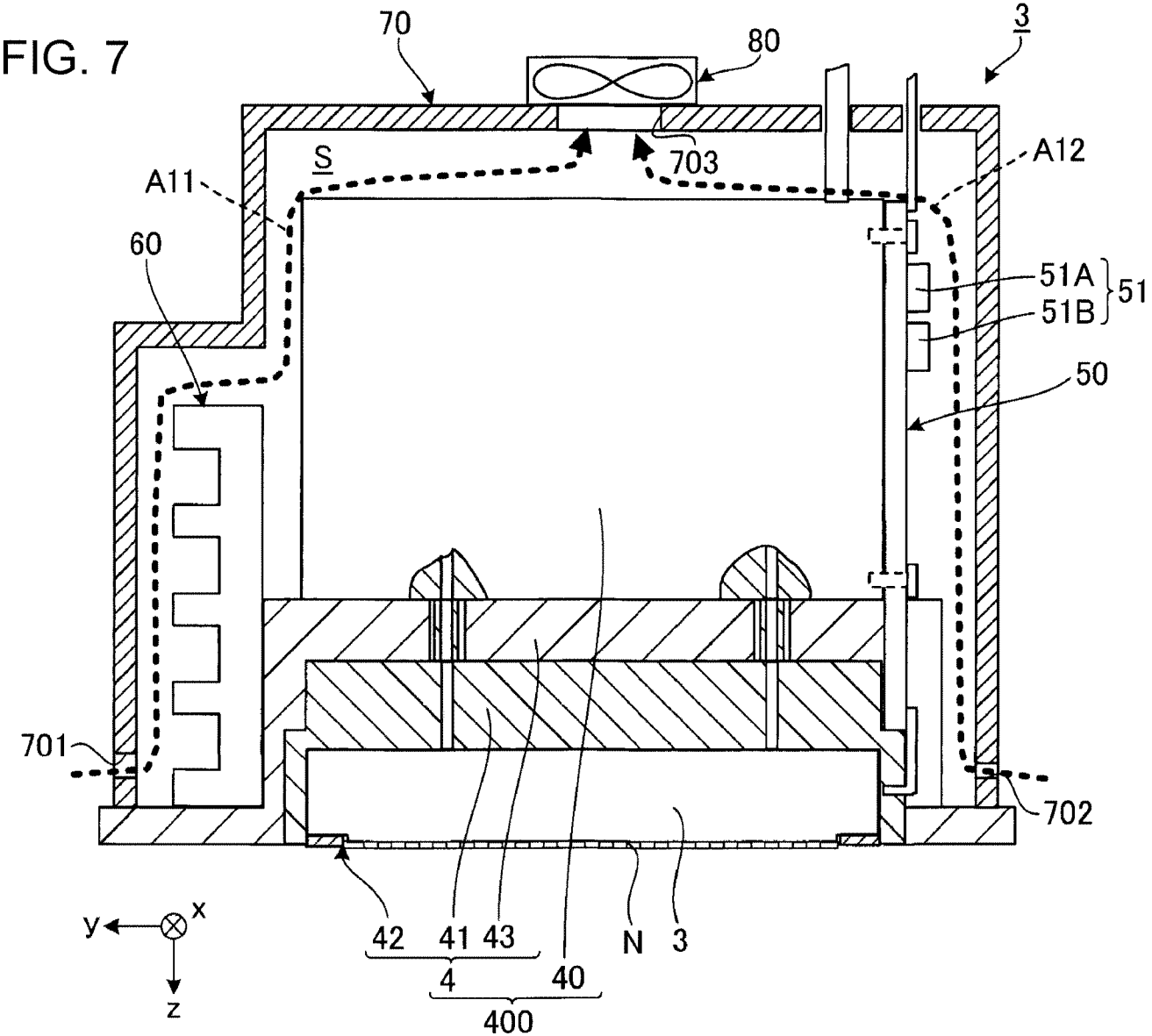
FIG. 7 illustrates a flow of air in a cover according to the embodiment.

FIG. 7 illustrates a flow of air in the cover 70 according to the embodiment. As illustrated in FIG. 7, after the fan 80 is driven, in the cover 70, an air flow from the first inlet 701 toward the outlet 703 indicated by arrow A11 is generated. Similarly, an air flow from the second inlet 702 toward the outlet 703 indicated by arrow A12 is generated. The fans 80 and the cover 70, which has the outlets 703, the first inlets 701, and the second inlets 702, function as a circulation section for circulating air in the space S.

2-2. Structure of Head Chip 3

Figure 8:
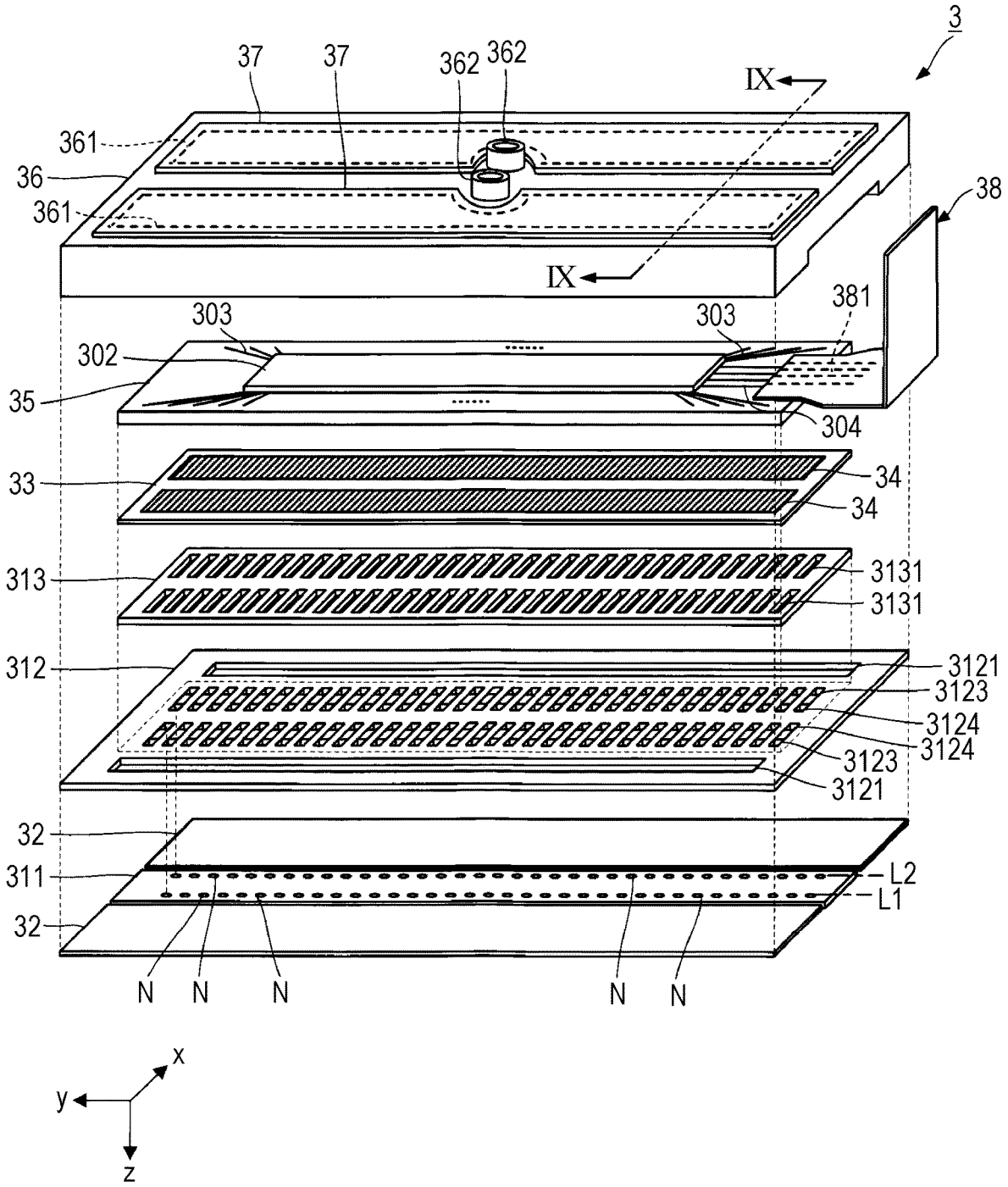
FIG. 8 is an exploded perspective view illustrating a head chip according to the embodiment.
Figure 9:
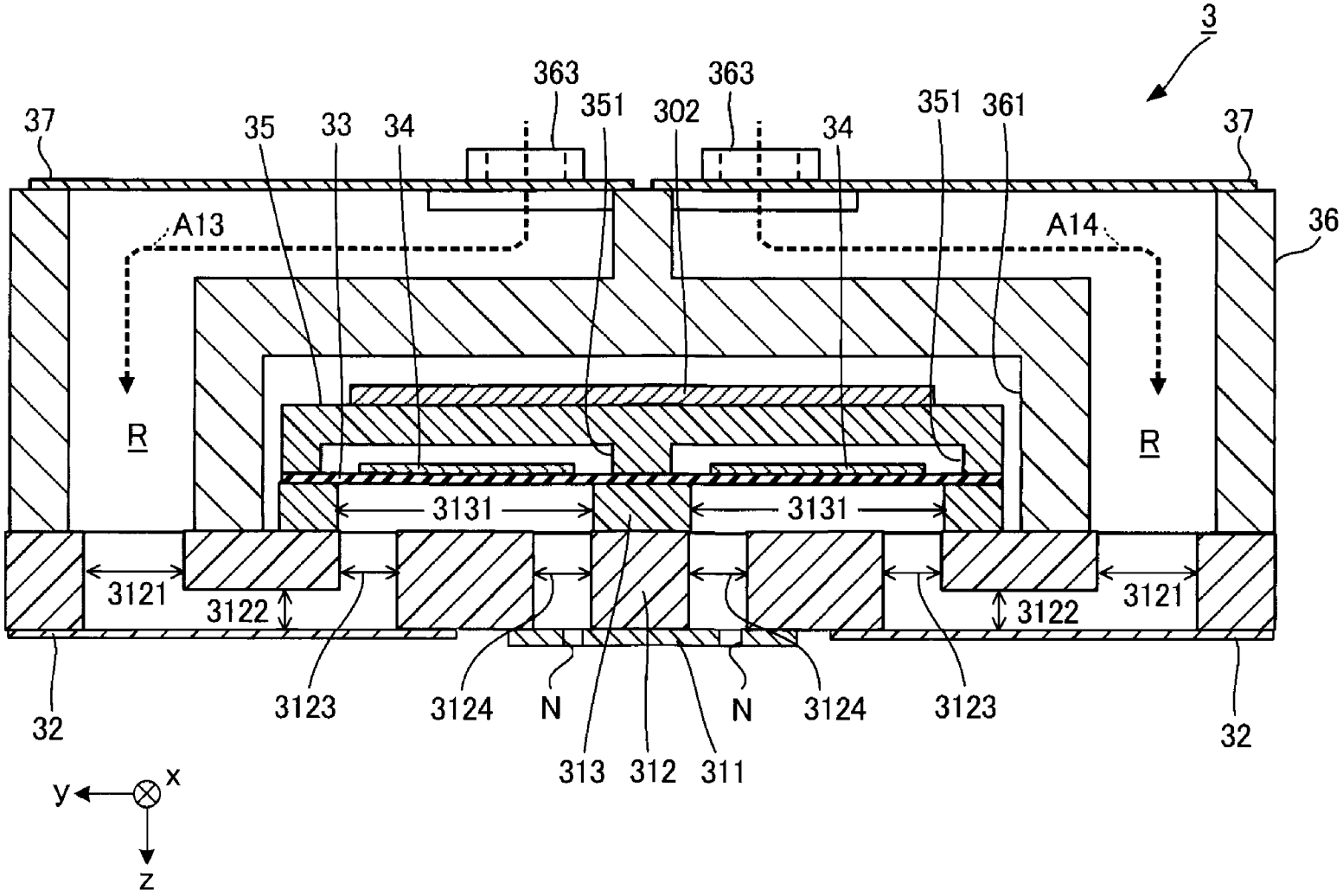
FIG. 9 is a cross-sectional view illustrating a head chip according to the embodiment.

FIG. 8 is an exploded perspective view illustrating the head chip 3 according to the embodiment. FIG. 9 is a cross-sectional view illustrating the head unit 3 according to the embodiment, and is a cross-sectional view taken along line IX-IX in FIG. 8.

The head chip 3 illustrated in FIG. 8 has a substantially rectangular shape when viewed from the +z direction. The head chip 3 includes a nozzle plate 311, a flow channel plate 312, a pressure chamber plate 313, two first vibration absorbing plates 32, a diaphragm 33, a plurality of piezoelectric elements 34, a protection plate 35, a case 36, and two second vibration absorbing plates 37. Each of the nozzle plate 311, the flow channel plate 312, the pressure chamber plate 313, the two first vibration absorbing plates 32, the diaphragm 33, the protection plate 35, the case 36, and the two second vibration absorbing plates 37 is a plate-shaped member that extends in the +y direction. On the head chip 3, a wiring member 38 is disposed. Hereinafter, the elements will be described.

2-2a. Nozzle Plate 311

The nozzle plate 311 has nozzles N for discharging ink. Each nozzle N is a through hole in the nozzle plate 311. The nozzles N are arranged at predetermined intervals. In the drawings, the nozzles N are arranged in two lines. The nozzles N are, specifically, arranged in a first line L1 along the +y direction and a second line L2 along the +y direction. The nozzle plate 311 is made of, for example, a silicon single-crystal substrate. The nozzles N are formed by processing the silicon substrate, for example, by etching.

2-2b. Flow Channel Plate 312

The flow channel plate 312 is disposed on the nozzle plate 311. The flow channel plate 312 includes two openings 3121, second flow channels 3123, and third flow channels 3124. As illustrated in FIG. 9, the flow channel plate 312 has first flow channels 3122.

As illustrated in FIG. 8, the two openings 3121 are each long through holes along the +y direction when viewed from the +z direction. One of the two openings 3121 corresponds to the first line L1. The other opening 3121 corresponds to the second line L2. The second flow channels 3123 and the third flow channels 3124 are through holes that are provided for corresponding nozzles N respectively. As illustrated in FIG. 9, each third flow channel 3124 overlaps a corresponding nozzle N when viewed from the +z direction. Each first flow channel 3122 is a space that communicates with the opening 3121 and one second flow channel 3123.

2-2c. Pressure Chamber Plate 313

As illustrated in FIG. 8, the pressure chamber plate 313 is disposed on the flow channel plate 312. The pressure chamber plate 313 has pressure chambers 3131. The pressure chambers 3131 are through holes that are provided for corresponding nozzles N respectively. As illustrated in FIG. 9, one pressure chamber 3131 communicates with one second flow channel 3123 and one third flow channel 3124.

Each of the flow channel plate 312 and the pressure chamber plate 313 is formed by processing a silicon single crystal substrate, for example, by etching. The nozzle plate 311, the flow channel plate 312, and the pressure chamber plate 313 may be made of, for example, glass, ceramics, metal, or resin.

2-2d. First Vibration Absorbing Plate 32

As illustrated in FIG. 9, two first vibration absorbing plates 32 are disposed on a surface of the flow channel plate 312 on the +z axis side. The first vibration absorbing plate 32 absorbs pressure fluctuations in a reservoir R, which will be described below. The two first vibration absorbing plates 32 are disposed to sandwich the nozzle plate 311 when viewed from the +z direction. The first vibration absorbing plates 32 are disposed on the flow channel plate 312 to seal the openings 3121, the first flow channels 3122, and the second flow channels 3123. The first vibration absorbing plate 32 has, for example, a flexible elastic film and a support plate that supports the elastic film. The support plate is made of, for example, a highly rigid material such as a stainless steel. The elastic film deforms in accordance with the pressure in a reservoir R to suppress pressure fluctuations in the reservoir R.

2-2e. Diaphragm 33

As illustrated in FIG. 9, the diaphragm 33 is disposed on the pressure chamber plate 313. The diaphragm 33 can elastically vibrate. The diaphragm 33 vibrates in accordance with the drive of the piezoelectric elements 34. The diaphragm 33 includes, for example, a laminated body that has an elastic film that contains silicon dioxide and an insulator film that contains zirconium oxide. A part or all of the diaphragm 33 may be integrally formed with the pressure chamber plate 313.

2-2f. Piezoelectric Element 34

As illustrated in FIG. 9, the piezoelectric elements 34 are disposed on the diaphragm 33. One piezoelectric element 34 overlaps with one pressure chamber 3131 when viewed from the +z direction. One piezoelectric element 34 is provided for one nozzle N. The piezoelectric element 34 is driven by a drive signal Com. The piezoelectric element 34 is a passive element that is driven by a change in potential of an individual drive signal Vin based on a drive signal Com. The piezoelectric element 34 is deformed in the +z direction or −z direction by driving. The deformation of the piezoelectric element 34 changes the pressure in the pressure chamber 3131, that is, the volume in the pressure chamber 3131. The change in pressure in the pressure chamber 3131 causes the ink filled in the pressure chamber 3131 to be discharged from the nozzle N via the third flow channel 3124. The piezoelectric element 34 has, for example, two electrodes and a piezoelectric layer disposed between the electrodes. For example, one of the two electrodes may be a common electrode for a plurality of piezoelectric elements 34, and the other electrode may be an individual electrode for each piezoelectric element 34.

As previously mentioned, the head chip 3 has a plurality of discharge sections 301. Each discharge section 301 has one piezoelectric element 34, a part of the diaphragm 33 that is in contact with the piezoelectric element 34, one first flow channel 3122, one second flow channel 3123, one pressure chamber 3131, and one third flow channel 3124. In the head chip 3, in each discharge section 301, ink is discharged from the nozzle N by the driving of the piezoelectric element 34.

2-2g. Protection Plate 35

As illustrated in FIG. 9, the protection plate 35 is disposed on the diaphragm 33. The protection plate 35 protects the piezoelectric elements 34. The protection plate 35 has two recessed portions 351 that are open on the +z axis side. The recessed portion 351 is a cavity in the protection plate 35. One of the two recessed portions 351 accommodates a plurality of piezoelectric elements 34 that correspond to the first line L1. The other recessed portion 351 accommodates a plurality of piezoelectric elements 34 that correspond to the second line L2. The piezoelectric elements 34 that are protected by the protection plate 35 are less affected by external influences than piezoelectric elements 34 that are not protected by the protection plate 35. The protection plate 35 may be made of, for example, glass, ceramics, metal, or resin.

As illustrated in FIG. 8, the selection circuit 302 is disposed on the protection plate 35. The selection circuit 302 is disposed on a surface of the protection plate 35 opposite to the piezoelectric elements 34. To the selection circuit 302, wires 303 on the protection plate 35 are coupled. One wire 303 is provided for one piezoelectric element 34. Although not illustrated in the drawings, the protection plate 35 has a contact section in a contact hole (not illustrated). Each wire 303 is electrically coupled to a corresponding piezoelectric element 34 via the contact section.

2-2h. Case 36

As illustrated in FIG. 9, the case 36 is disposed on the flow channel plate 312. The case 36 has a recessed portion 361 and two reservoirs R. The recessed portion 361 is a cavity that is open in the +z direction in the case 36. The recessed portion 361 extends in the +y direction. In the recessed portion 361, the pressure chamber plate 313, the diaphragm 33, the piezoelectric elements 34, the protection plate 35, and the selection circuit 302 are accommodated.

The two reservoirs R are reservoirs for storing ink. The reservoirs R are space in the case 36. The reservoirs R are open on a surface on the +z axis side and a surface on the −z axis side of the case 36 respectively. One reservoir R communicates with one opening 3121. On the surface of the case 36 on the +z axis side, two inlets 363 through which the ink supplied from the liquid container 9 via the liquid flow channel 49 is supplied are provided. One inlet 363 communicates with one reservoir R.

2-2i. Second Vibration Absorbing Plate 37

The second vibration absorbing plate 37 is disposed on the case 36 to seal the opening of the case 36 on the −z axis side. The second vibration absorbing plate 37 absorbs pressure fluctuations of the ink in the reservoir R. The second vibration absorbing plate 37 has, for example, a flexible elastic film and a support plate that supports the elastic film, similarly to the first vibration absorbing plate 32.

In the head chip 3, as indicated by arrow A13 or arrow A14 in FIG. 9, the ink that is supplied from the inlet 363 into the reservoir R is drawn into the reservoir R and stored. The ink in the reservoir R is supplied to the opening 3121 and distributed from the opening 3121 to each first flow channel 3122. Then, as described above, in each discharge section 301, the ink is discharged from the nozzle N by the driving of the piezoelectric element 34.

2-3. Wiring Member 38

As illustrated in FIG. 8, the wiring member 38 is coupled to the protection plate 35. The wiring member 38 is, for example, a flexible wiring board such as a flexible printed circuit (FPC). The wiring member 38 protrudes from the protection plate 35 in the −y direction and is bent in the −z direction. The wiring member 38 protrudes more than the case 36 toward the −z axis side. The portion that is bent toward the −z direction is coupled to the circuit board 50.

The wiring member 38 includes connection wires 381. The connection wires 381 are electrically coupled to the selection circuit 302 via the wires 304 on the protection plate 35. The connection wires 381 are also electrically coupled to the drive-signal generation circuit 51 in the circuit board 50. Accordingly, the wiring member 38 electrically couples the selection circuit 302 and the drive-signal generation circuit 51. The wiring member 38 supplies a drive signal Com from the drive-signal generation circuit 51 to the selection circuit 302.

2-4. Arrangement of Head Chips 3

Figure 10:
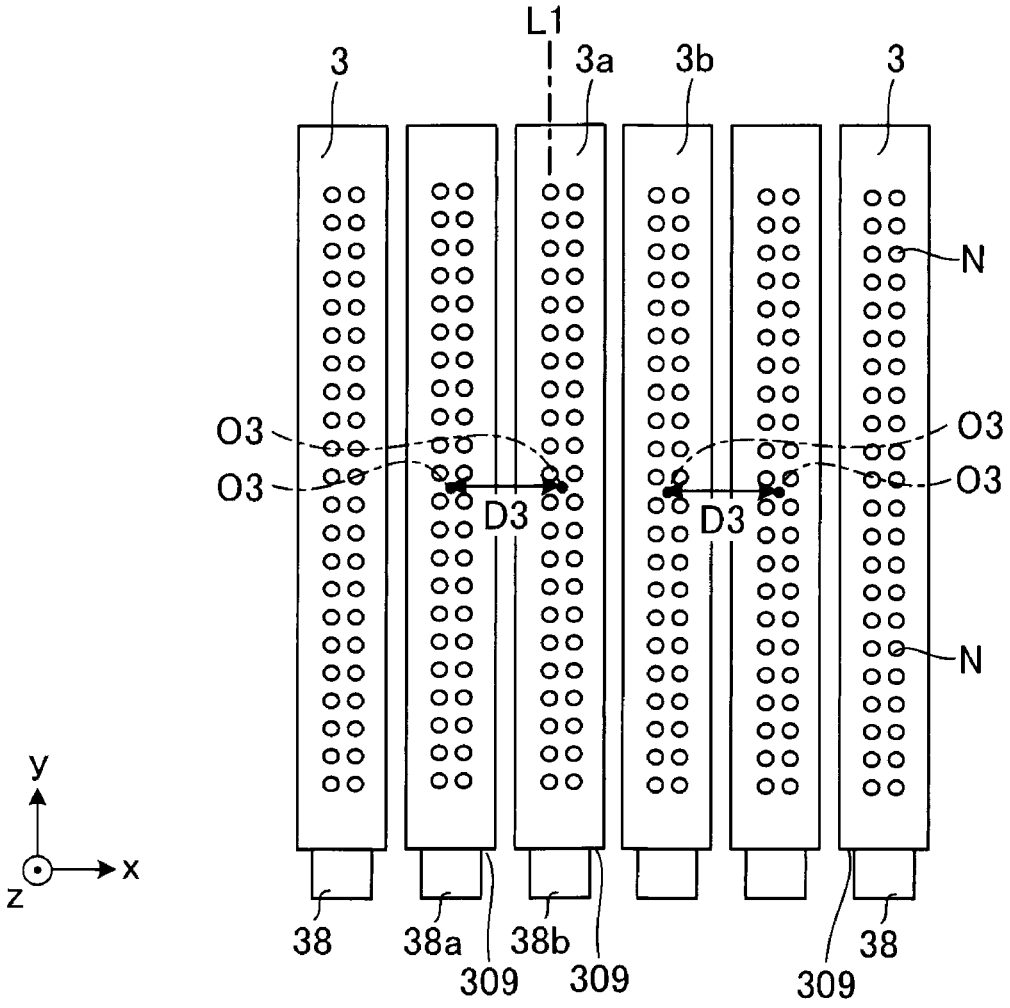
FIG. 10 is a plan view illustrating an arrangement of head chips according to the embodiment.

FIG. 10 is a plan view illustrating an arrangement of the head chips 3 according to the embodiment. FIG. 10 schematically illustrates nozzles N in the head chip 3 to facilitate understanding.

As illustrated in FIG. 10, the head chips 3 include a first head chip 3*a* and a second head chip 3*b*. The first head chip 3*a* is a head chip 3 in the plurality of head chips 3. The second head chip 3*b* is a head chip 3 that is adjacent to the first head chip 3*a* in the head chips 3. The second head chip 3*b* is on the +x side with respect to the first head chip 3*a*; however, the second head chip 3*b* may be on the −x side.

The first head chip 3*a* and the second head chip 3*b* are arrayed in the +x direction with a pitch D3, which is a "predetermined pitch". The first head chip 3*a* and the second head chip 3*b* are aligned, specifically, in a direction a center O3 of the first head chip 3*a* and a center O3 of the second head chip 3*b* are aligned. The pitch D3 is a distance between the center O3 of the first head chip 3*a* and the center O3 of the second head chip 3*b*. The pitch D3 is, accordingly, a center distance between the first head chip 3*a* and the second head chip 3*b*. The center O3 of the first head chip 3*a* is a geometric center of the first head chip 3*a*. The same applies to the center O3 of the second head chip 3*b*. In this embodiment, all of the head chips 3 are aligned along the +x direction with the pitch D3.

On each head chip 3, as described above, the wiring member 38 is disposed. When the wiring member 38 that is disposed on the first head chip 3*a* is a first wiring member 38*a* and the wiring member 38 disposed on the second head chip 3*b* is a second wiring member 38*b*, the first wiring member 38*a* and the second wiring member 38*b* are arranged in the +x direction. The first wiring member 38*a* and the second wiring member 38*b* are aligned along the direction the first head chip 3*a* and the second head chip 3*b* are aligned.

The first wiring member 38*a* is disposed at one end 309 of the first head chip 3*a* in the +y direction and similarly, the second wiring member 38*b* is disposed at one end 309 of the second head chip 3*b* in the +y direction. In this embodiment, each wiring member 38 is disposed at one end 309 of a corresponding head chip 3 in the +y direction. Consequently, all the wiring members 38 are aligned along the +x direction.

2-5. Circuit Board 50

Figure 11:
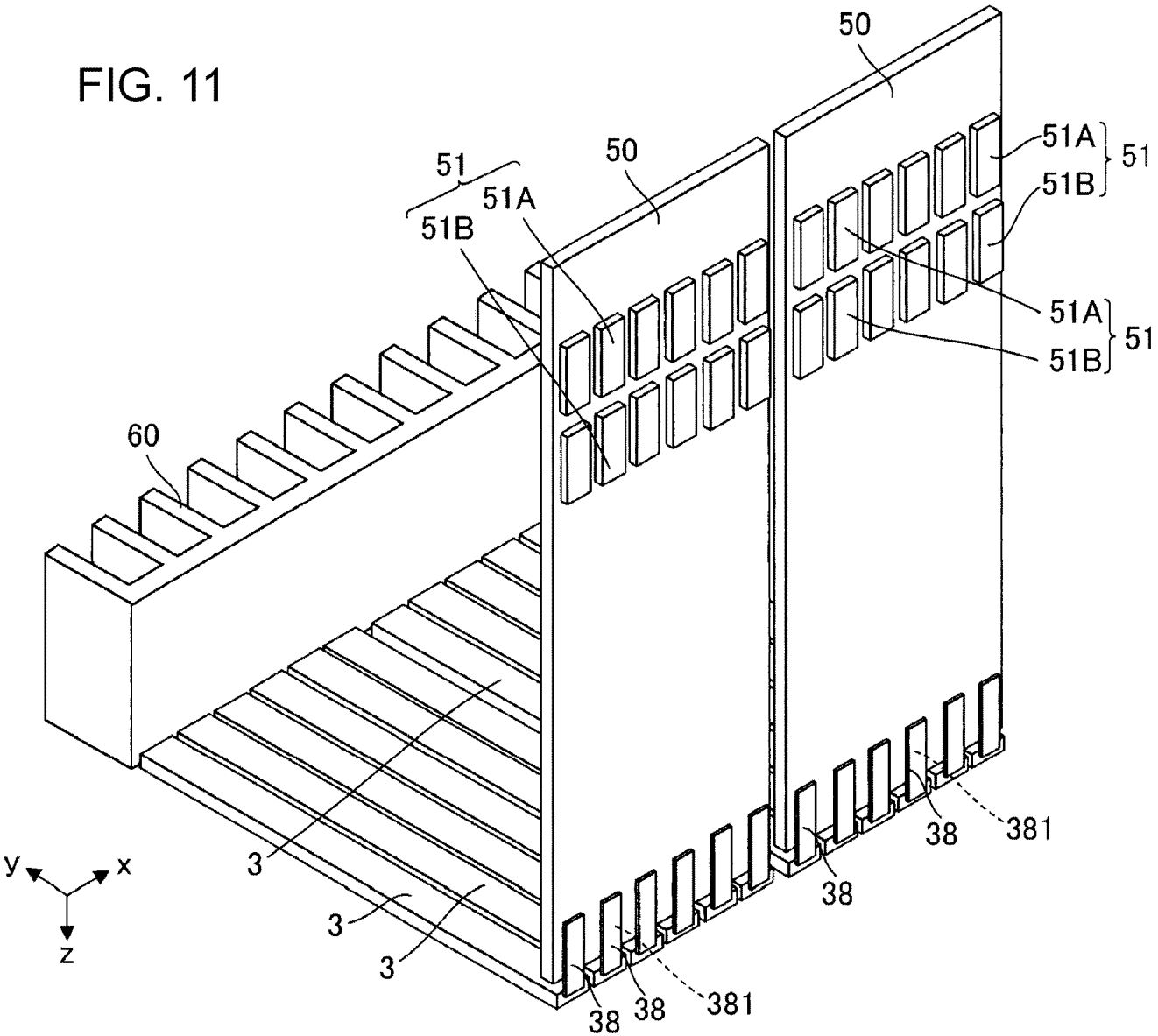
FIG. 11 is a schematic perspective view illustrating circuit boards, head chips, and a heat sink according to the embodiment.

FIG. 11 is a schematic perspective view illustrating the circuit boards 50, the head chips 3, and the heat sink 60 according to the embodiment. As illustrated in FIG. 11, the drive-signal generation circuits 51 on the circuit board 50 are disposed at positions farther from the head chips 3 than the heat sink 60 in the −z direction.

On the circuit board 50, the wiring members 38 are disposed. One drive-signal generation circuit 51 is provided for one wiring member 38. One drive-signal generation circuit 51 is provided for one head chip 3 accordingly. With this structure, a drive signal Com that is generated in accordance with characteristics of each head chip 3 can be supplied to each corresponding head chip 3, and thereby the print quality can be increased. The connection wire 381 of the wiring member 38 and the drive-signal generation circuit 51 that corresponds to the connection wire 381 are coupled via a wire (not illustrated) of the circuit board 50.

Figure 12:
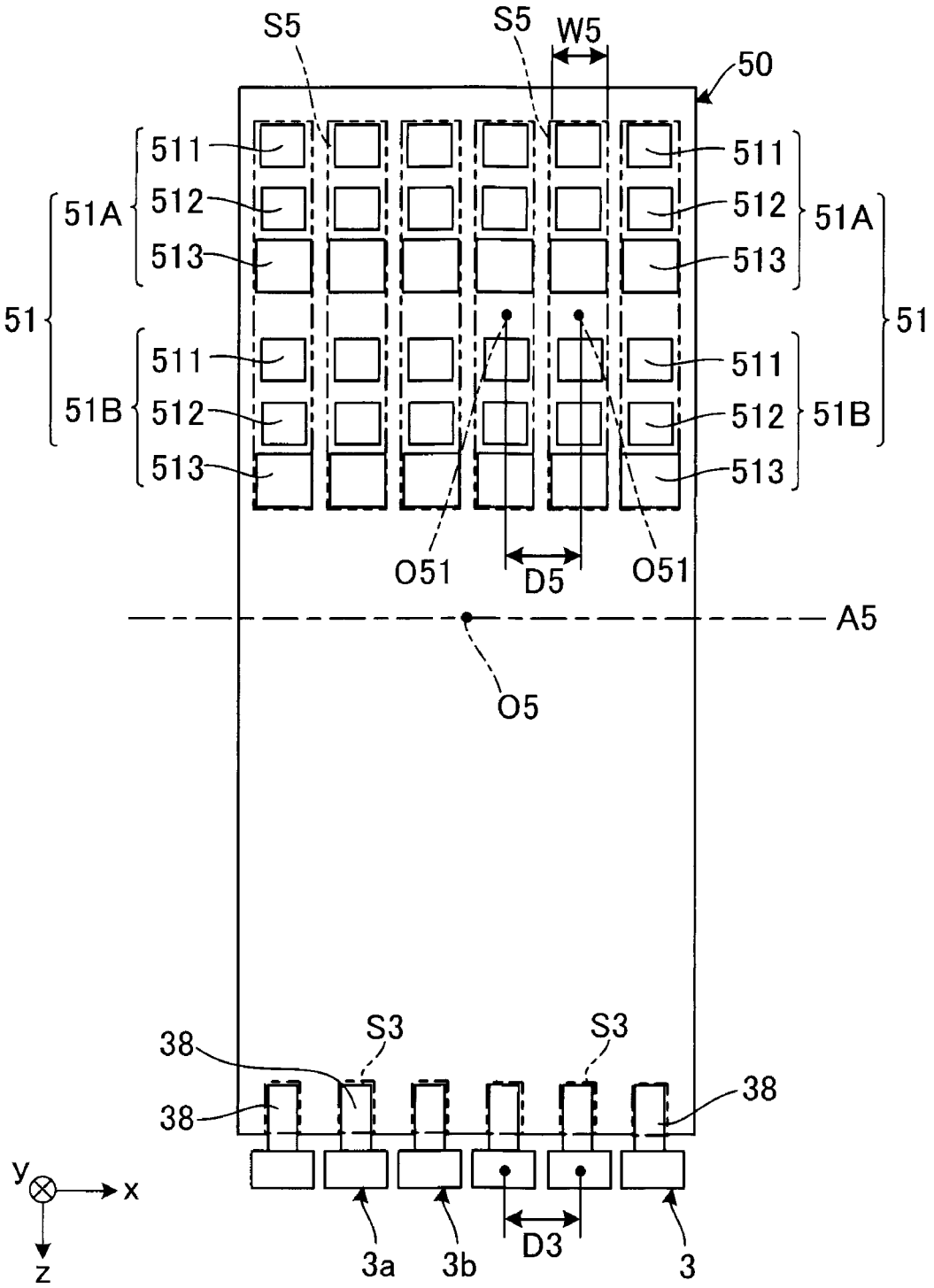
FIG. 12 is a plan view illustrating a circuit board according to the embodiment.

FIG. 12 is a plan view illustrating the circuit board 50 according to the embodiment. As illustrated in FIG. 12, the circuit board 50 has circuit areas S5 and wiring areas S3. One drive-signal generation circuit 51 is provided in one circuit area S5. One wiring member 38 is provided in one wiring area S3. The circuit area S5 is located on the −z axis side with respect to a center line A5. On the other hand, the wiring area S3 is located on the +z axis side with respect to the center line A5. The center line A5 is a line segment that passes through the center O5 of the circuit board 50 and is parallel to the +x direction.

The circuit areas S5 are located along the +x direction. Consequently, the drive-signal generation circuits 51 are located along the +x direction. The wiring areas S3 are located along the +x direction. Consequently, the wiring members 38 are located along the +x direction as previously mentioned. The circuit areas S5 are aligned with an equal pitch D5. In this embodiment, the pitch D5 is substantially equal to the pitch D3 of the head chip 3, but may be a pitch different from the pitch D3. The pitch D5 is a center distance between adjacent circuit regions S5. A width W5 of the circuit area S5 is narrower than the pitch D3 of the head chip 3. The width W5 is a width of the circuit area S5 in the +x direction. The width W5 is, accordingly, the length of the circuit area S5 along the alignment direction of the first head chip 3*a* and the second head chip 3*b*.

The first drive-signal generation circuit 51A is located on the −z axis side with respect to the second drive-signal generation circuit 51B. The first drive-signal generation circuit 51A is disposed at a position farther from the head chip 3 than the second drive-signal generation circuit 51B accordingly. One first drive-signal generation circuit 51A, one second drive-signal generation circuit 51B, and one wiring member 38 are aligned along the +z direction. Accordingly, high-density head chips 3 can be provided as compared to head chips 3 that are not aligned along the +z direction.

The first drive-signal generation circuit 51A and the second drive-signal generation circuit 51B each include a large scale integration (LSI) circuit 511, which serves as a modulation circuit, an amplifier circuit 512, and a low pass filter (LPF) 513.

The LSI 511 includes a digital-to-analog converter (DAC) and a gate driver. To the LSI 511, a waveform specifying signal dCom is input from the controller 11. The LSI 511 converts the waveform-designating signal dCom into an analog signal and based on the waveform-designating signal dCom, generates a modulating signal for driving a transistor in the amplifier circuit 512. The amplifier circuit 512 includes a transistor on a high side and a transistor on a low side. As example transistors, n-channel type field effect transistors (FETs) may be used. The amplifier circuit 512 amplifies a modulating signal that is input from the LSI 511 to generate an amplified signal. The LPF 513 includes a coil. The LPF 513 smooths the amplified signal input from the amplifier circuit 512 to generate a drive signal Com.

The LPF 513, the amplifier circuit 512, and the LSI 511 are aligned in this order from the head chip 3 side along the −z direction. Accordingly, the LPF 513 is closest to the head chip 3 and the LSI 511 is farthest from the head chip 3. This arrangement allows the LPF 513, the amplifier circuit 512, and the LSI 511 to be aligned in a line. Accordingly, the further reduced width W5 of the circuit area S5 can be achieved, and the high-density head chips 3 can be provided. The transistor on the high side and the transistor on the low side in the amplifier circuit 512 are mounted in one package. Accordingly, the reduced width W5 of the circuit area S5 can be achieved as compared to a transistor on a high side and a transistor on a low side that are mounted in separate packages.

As described above, the head unit 10 includes the head chips 3, the circuit boards 50, the connection wires 381, and the flow channel unit 400. The head chips 3 each include the piezoelectric elements 34, and ink is discharged from the nozzles N by the driving of the piezoelectric elements 34. The circuit board 50 has the drive-signal generation circuit 51 that generates a drive signal Com for driving the piezoelectric elements 34. The wiring member 381 electrically couples the head chip 3 and the drive-signal generation circuit 51. The flow channel unit 400 has the liquid flow channel 49 for supplying ink to the head chips 3. The head chips 3 and the circuit boards 50 are fixed to the flow channel unit 400.

The head chips 3 and the circuit boards 50 are fixed to the same flow channel unit 400, and this structure allows to reduce the distance between each head chip 3 and each circuit board 50 as compared to head chips 3 and circuit boards 50 that are not fixed to the same unit, and thus, the length of the connection wire 381 can be reduced. The head chips 3 and the circuit boards 50 are fixed to the same flow channel unit 400, and thereby the head unit 10 that has the head chips 3 and the circuit boards 50 can be implemented. With this structure, the distance between each head chip 3 and each circuit board 50 can be reduced as compared to a control unit 1 that has circuit boards 50, and thus the length of the connection wire 381 can be reduced. With this structure, noise on the connection wire 381 due to a long wiring length can be reduced, and thereby the variations in the drive waveform of a drive signal Com can be reduced, and print quality degradation due to the noise can be suppressed.

Examples of the noise include increased magnetic flux due to an increase in inductance of the connection wire 381, a change in magnetic flux due to mutual inductance of the connection wires 381, and variations in the connection wire 381. For example, the inductance of the connection wire 381 increases as the length of the connection wire 381 increases, and an overshoot may occur in a drive waveform. As a result, a discharge malfunction may occur. The head unit 10, however, has the short connection wires 381, and thus a discharge malfunction can be prevented or reduced.

Furthermore, the flow channel unit 400 to which the head chips 3 and the circuit boards 50 are fixed eliminates separate members to which the head chips 3 and the circuit boards 50 are to be fixed. Accordingly, an increase in size of the head unit 10 can be prevented.

The high-densely nozzles N need the increased number and density of the connection wires 381, and this may cause noise and print quality deterioration. However, in the head unit 10, the distance between each head chip 3 and each circuit board 50 is short as previously described, and thus such effects of noise can be effectively reduced. In particular, a head chip 3 that has 1,000 or more nozzles N with a pitch of 500 dpi or more can effectively prevent the head unit 10 from printing at a low print quality level. For example, the number of nozzles N in the head unit 10 may be less than 1,000 and a pitch between the nozzles N may be 500 dpi.

On the connection wires 381, the wiring member 38 is disposed as described above. In some embodiments, the wiring member 38 is a flexible printed circuit (FPC). Among flexible wiring boards, flexible printed circuits have high flexibility. Consequently, a flexible printed circuit that is used as the wiring member 38 can stably and electrically couple the head chip 3 and the circuit board 50 by the connection wires 381 when the extending surface of the head chip 3 and the extending surface of the circuit board 50 intersect each other as illustrated in FIG. 5. With this structure, while flexibility in the arrangement of the head chips 3 and the circuit boards 50 can be increased, print quality degradation due to noise can be reduced. Furthermore, the arrangement of the connection wires 381 on the wiring member 38 allows the connection wires 381 to be disposed together, and thus the electrical connection between the head chip 3 and the circuit board 50 can be stably and readily implemented. The wiring member 38 may be a flexible wiring board such as a flexible flat cable (FFC). The wiring member 38 may be a rigid wiring board.

The head chip 3 and the circuit board 50 arranged such that the extending surface of the head chip 3 and the extending surface of the circuit board 50 intersect each other can increase the flexibility in the arrangement of the wiring in the circuit board 50 as compared to an arrangement in which a head chip 3 and a circuit board 50 are parallel and face each other. With this structure, the drive-signal generation circuits 51 can be disposed at a high density.

As illustrated in FIG. 5, the circuit board 50 is screwed on the flow channel unit 400. The circuit board 50 is fixed to the flow channel unit 400 with the screws 502. The circuit board 50 can be stably fixed to the flow channel unit 400 by screwing, as compared to, for example, a circuit board 50 that is fixed to the flow channel unit 400 with only an adhesive. Consequently, this structure can suppress print quality degradation due to noise. The circuit board 50 may be fixed to the flow channel unit 400 by a method other than screwing. The circuit board 50 may be fixed to the flow channel unit 400, for example, by using an adhesive.

The circuit board 50 is fixed to the flow channel unit 400 at some points. The circuit board 50 according to the embodiment is fixed to the flow channel unit 400 with the screws 502. The circuit board 50 fixed at some points can be stably fixed to the flow channel unit 400 as compared to, for example, a circuit board 50 that is fixed to the flow channel unit 400 at one point. Consequently, this structure can further suppress print quality degradation. The circuit board 50 may be fixed to the flow channel unit 400 at only one point.

As described above, the first drive-signal generation circuit 51A and the second drive-signal generation circuit 51B are aligned along the +z direction. With this structure, the width W5 of the circuit area S5 can be reduced as compared to an arrangement in which a first drive-signal generation circuit 51A and a second drive-signal generation circuit 51B in one drive-signal generation circuit 51 are aligned in the +x direction. Accordingly, the head chips 3 can be disposed at a high density, and thus many nozzles N can be disposed at a high density. Furthermore, even though the head chips 3 are disposed at a high density, the head unit 10 can effectively suppress print quality degradation due to noise, and thus the head unit 10 with high resolution and high printing accuracy can be implemented.

As previously mentioned, the width W5 of the circuit area S5 is narrower than the pitch D3. The drive-signal generation circuits 51 that have the width W5 narrower than the pitch D3 implement the head unit 10 with high resolution and high printing accuracy.

As described above, the first drive-signal generation circuit 51A and the second drive-signal generation circuit 51B are aligned along the +z direction, and thereby the width W5 that is narrower than the pitch D3 can be achieved. When the first drive-signal generation circuit 51A and the second drive-signal generation circuit 51B are not aligned along the +z direction, if a width W2 of the circuit area S5 is narrower than the pitch D3, the head unit 10 with high resolution and high printing accuracy can be achieved.

As illustrated in FIG. 9, the head unit 10 includes the head chip 3 that includes the piezoelectric elements 34, the protection plate 35, and the selection circuit 302. The protection plate 35 protects the piezoelectric elements 34. The selection circuit 302 is disposed on the protection plate 35 and selects to supply or not to supply a drive signal Com to the piezoelectric elements 34. As illustrated in FIG. 5, the head unit 10 includes the heat sink 60, and the supporting member 4, which serves as a "thermal conductor". The supporting member 4 couples the head units 3 and the heat sink 60. The head chips 3 are in contact with the supporting member 4. Similarly, the heat sink 60 is in contact with the supporting member 4. The head chips 3 and the heat sink 60 that are coupled by the supporting member 4 conduct heat generated in the head chips 3 to the heat sink 60 via the supporting member 4. Accordingly, the heat radiation performance of the head chips 3 can be increased. As a result, a decrease in ink viscosity due to an increase in ink temperature caused by increased heat generation by the head chips 3 can be suppressed, and thus print quality degradation due to the heat generated by the head chips 3 can be suppressed.

As previously mentioned, the head chip 3 includes the selection circuit 302 that has the transmission gates. The amount of heat generated by the head chips 3 is greater than that by a structure that has no selection circuit 302. Accordingly, the heat sink 60 is disposed via the supporting member 4 to effectively suppress the print quality degradation due to the heat generated by the head chips 3 including the selection circuits 302. Furthermore, this structure suppresses shortening of the life of the selection circuit 302 and other components due to heat.

As illustrated in FIG. 10, the first head chip 3*a* and the second head chip 3*b* are disposed in the +x direction. In this embodiment, all of the head chips 3 are disposed in the +x direction. The first wiring member 38*a* and the second wiring member 38*b* are disposed along the +x direction. In this embodiment, all of the wiring members 38 are disposed in the +x direction. Accordingly, on one side of the head chip 3 of the first line L1, the circuit board 50 can be disposed, and on the other side, the heat sink 60 can be disposed. As previously mentioned, the head chips 3 are disposed between the circuit boards 50 and the heat sink 60 when viewed from the +z direction. With this structure, the circuit boards 50, the heat sink 60, and the head chips 3 can be efficiently disposed with the increased heat radiation performance of the head chips 3.

When viewed from the +z direction, a part or all of the head chips 3 may overlap the circuit boards 50 or the heat sink 60. The arrangement of the wiring members 38 is not limited to the arrangement illustrated in FIG. 10. For example, the first wiring member 38*a* may be disposed at the end 309 of the first head chip 3*a* on the +y side, and the second wiring member 38*b* may be disposed at the end opposite to the end 309 of the second head chip 3*b* on the −y side.

As previously mentioned, the head unit 10 includes the cover 70 that accommodates a part of the head chips 3 and the fans 80 that move the air between the cover 70 and the head chips 3. In this embodiment, specifically, the cover 70 allows the movement of the air in the space S between the cover 70 and the head chips 3, the heat sink 60, the circuit boards 50, and the flow channel unit 400. The fans 80 can force the air in the space S to flow. As the air flows, heat is conducted from the head chips 3, which are heating elements, to the air in the space S. The convection dissipates the heat of the head chips 3, and the temperature rise of the head chips 3 can be suppressed, suppressing the temperature rise of the ink in the head chips 3. Consequently, this structure can suppress print quality degradation due to heat. Furthermore, this structure suppresses shortening of the life of the selection circuits 302 and other components due to heat. The fans 80 reduce temperature unevenness in the space S and thus variations in temperature of the head chips 3 can be reduced.

As previously mentioned, the head chip 3 includes the selection circuit 302 that has the transmission gates. The amount of heat generated by the head chips 3 each having the selection circuit 302 is greater than that by a structure that has no selection circuit 302 as mentioned above. Accordingly, the fans 80 are disposed to effectively suppress the print quality degradation due to the heat generated by the head chips 3 each having the selection circuit 302. Furthermore, this structure suppresses shortening of the life of the selection circuits 302 and other components due to heat. The fans 80 reduce temperature unevenness in the space S and thus variations in temperature of the head chips 3 can be reduced.

The cover 70 may accommodate a part or all of the head chips 3 as long as the space S can be provided between the cover 70 and the head chips 3. Similarly, the cover 70 may accommodate a part or all of the heat sink 60 as long as the space S can be provided between the cover 70 and the heat sink 60. The same applies to the flow channel unit 400 and the circuit boards 50.

As illustrated in FIG. 7, the cover 70 has the first inlets 701 and the second inlets 702 for drawing air outside the cover 70 into the space S between the cover 70 and the head chip 3, and the outlets 703 for discharging air from the space S. The head chip 3 is disposed at the position closer to the first inlet 701 and the second inlet 702 than the outlet 703. The fan 80 is driven to move air from the first inlets 701 toward the outlets 703 as mentioned above. Similarly, air moves from the second inlet 702 toward the outlet 703. The head chip 3 that is disposed at the position closer to the first inlet 701 and the second inlet 702 than the outlet 703 efficiently dissipate the heat generated by the head chip 3. The head chip 3 may be disposed at a position closer to the outlet 703 than the first inlet 701 and the second inlet 702.

Furthermore, the head chip 3 has 1,000 or more nozzles N with a pitch of 500 dpi or more that are arranged at a high density and has many piezoelectric elements 34 that are arranged at a high density. The head chip 3 generates heat and the heat can decrease the viscosity of ink. The head unit 10, however, can move the air in the space S by the driving of the fans 80, and thus the heat generated by the head chips 3 can be efficiently dissipated, and print quality degradation can be increased.

The circuit board 50 has the drive-signal generation circuit 51 that generates a drive signal Com as previously mentioned. As the electric current of a drive signal Com output from the drive-signal generation circuit 51 increases, the electric current that flows through the transistors and coil in the drive-signal generation circuit 51 increases. Consequently, the amount of heat generated by the drive-signal generation circuit 51 increases. As a result, problems due to the heat generated by the drive-signal generation circuit 51 may occur or print quality degradation may occur. Accordingly, the heat sink 60 and the fans 80 are provided to effectively reduce the problems, specifically, print quality degradation.

The drive-signal generation circuit 51 is disposed at a position closer to the fan 80 than the head chip 3. With this structure, the heat generated by the drive-signal generation circuit 51 can be efficiently dissipated. The drive-signal generation circuits 51 are disposed on the −z side with respect to the center line A5 to separate the drive-signal generation circuits 51 from the head chips 3 as compared to a structure in which the drive-signal generation circuits 51 are disposed on the +z side with respect to the center line A5. With this structure, the heat sources can be disposed at different locations. Accordingly, the temperature evenness in the space S can be maintained and variations in print quality in the head chips 3 can be suppressed. The head chips 3 may be disposed at positions closer to the fans 80 than the drive-signal generation circuits 51.

The second drive signal Com-B has a larger amplitude than that of the first drive signal Com-A as previously mentioned. Consequently, the amount of heat generated by the first drive-signal generation circuit 51A tends to be larger than that by the second drive-signal generation circuit 51B. The first drive-signal generation circuit 51A is disposed at a position farther from the head chip 3 than the second drive-signal generation circuit 51B, and thus print quality degradation can be further suppressed.

The above-described liquid discharge apparatus 100 includes the head unit 10 and the control unit 1 for controlling the head unit 10. The liquid discharge apparatus 100 includes the head unit 10, and thereby print quality degradation can be effectively suppressed. The liquid discharge apparatus 100 may include at least the control unit 1 and the head unit 10, and the structure is not limited to the structure illustrated in FIG. 1.

3. Modifications

The above-described embodiment may be modified in various ways. Specific modifications applicable to the above-described embodiment will be described below. Two or more modifications selected from those below may be combined without a contradiction between them.

3-1. First Modification

In the above-described embodiment, the head chips 3 are long and disposed along the +y direction; however, the arrangement and shape of the head chips 3 are not limited to this example. The nozzles N in the head chip 3 are arranged along the +y direction, but may be arranged along a different direction. For example, the nozzles N in the head chip 3 may be arranged along the +x direction. The "intersecting direction" is a direction that intersects the discharge direction, and not limited to the +x direction. For example, the "intersecting direction" may be the +y direction.

Figure 13:
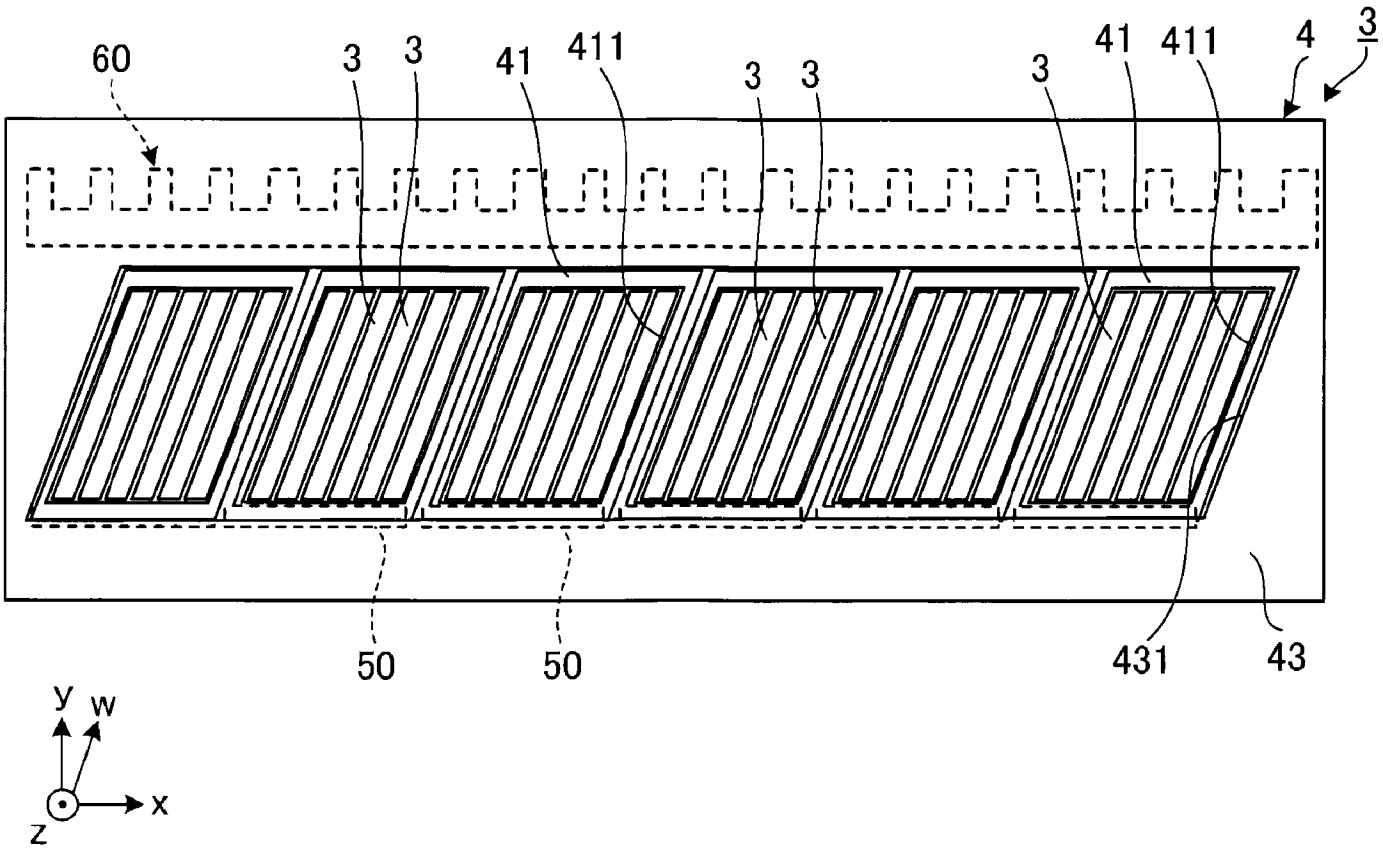
FIG. 13 is a plan view illustrating a head unit according to a first modification.
Figure 14:
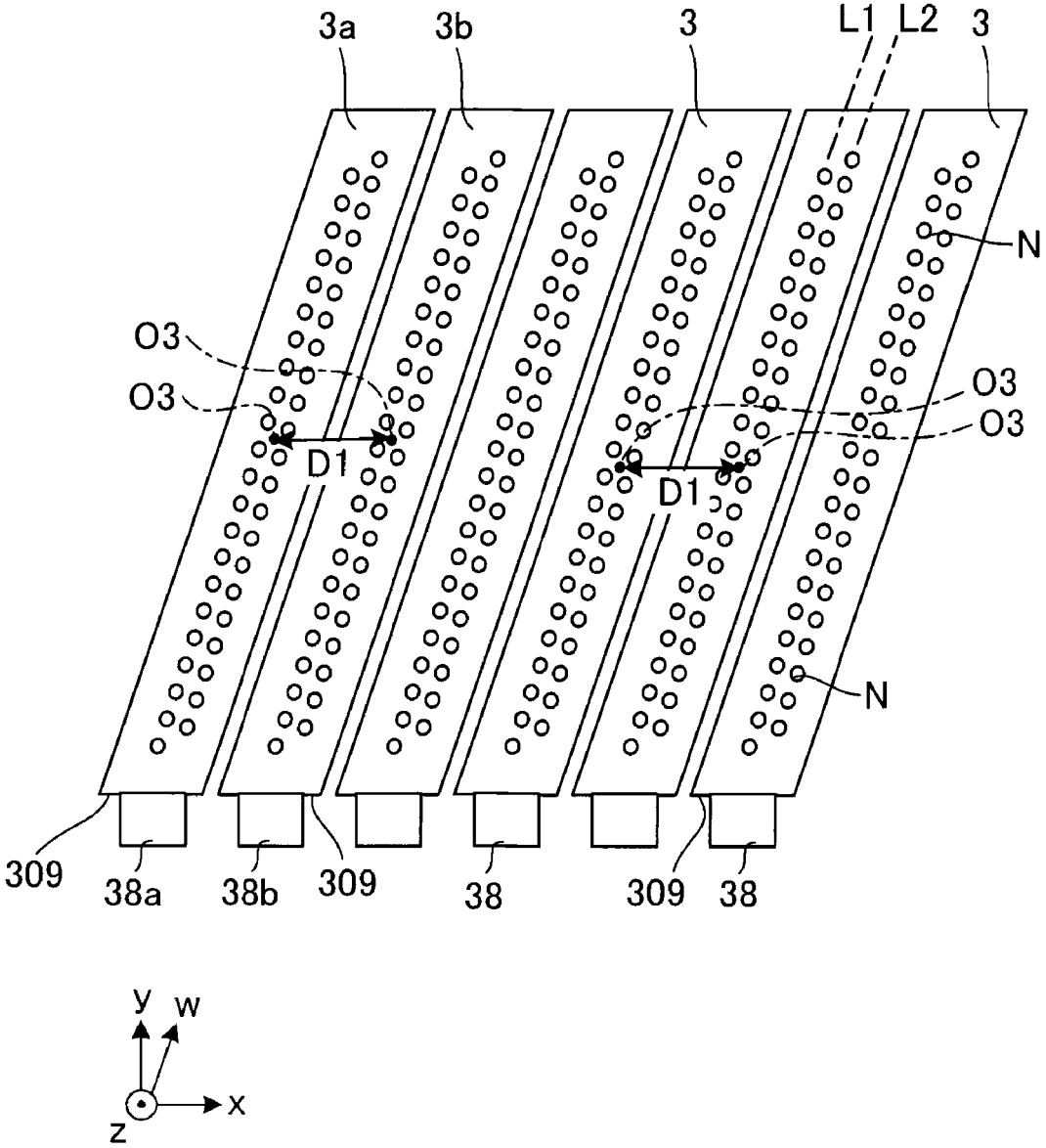
FIG. 14 is a plan view illustrating an arrangement of head chips according to the first modification.

FIG. 13 is a plan view illustrating a head unit 10 according to a first modification. FIG. 14 is a plan view illustrating head chips 3 according to the first modification. For example, as illustrated in FIG. 13, the head chips 3 may be arranged in a direction along a w axis that intersects the x axis and the y axis in an x-y plane. Furthermore, as illustrated in FIG. 14, the nozzles N in one head chip 3 may be arranged in a direction along the w axis. In such a case, the nozzles N are arranged in a first line L1 along the +w axis and a second line L2 along the +w axis.

3-2. Second Modification

In the above-described embodiment, the head unit 10 is a line head; however, the "head unit" may be a serial head that reciprocates along the +x direction together with the movement of a carriage.

3-3. Third Modification

In the above-described embodiment, the example "liquid" is an ink that contain a pigment or a dye, but the "liquid" may be a liquid that contains no pigment or dye.

3-4. Fourth Modification

The structure of the head chip 3 includes a "drive element" and is configured to discharge "liquid" but is not limited to the structure illustrated in FIG. 8. For example, a plurality of "drive elements" may be provided for one nozzle N. In the above-described embodiment, the example "drive element" is the piezoelectric element 34, but the "drive element" may be a heating element that generates bubbles in a pressure chamber by heating to change the pressure in the pressure chamber.

3-5. Fifth Modification

In the above-described embodiment, the drive-signal generation circuit 51 includes the first drive-signal generation circuit 51A and the second drive-signal generation circuit 51B, but one of the first drive-signal generation circuit 51A and the second drive-signal generation circuit 51B may be omitted. The drive signal Com includes two signals: the first drive signal Com-A and the second drive signal Com-B. However, the drive signal Com may include one of the two signals.

3-6. Sixth Modification

In the above-described embodiment, one circuit board 50 is disposed for six head chips 3, but one circuit board 50 may be disposed for one head chip 3. Alternatively, only one circuit board 50 may be provided for all head chips 3. In the above-described embodiment, one drive-signal generation circuit 51 is provided for one head chip 3, but one drive-signal generation circuit 51 may be provided for a plurality of head chips 3. Alternatively, no drive-signal generation circuit 51 may be provided in the head unit 10 and the drive-signal generation circuit 51 may be provided in the control unit 1.

3-7. Seventh Modification

The number of the head chips 3 in the head unit 10 is not limited to 36 as illustrated in FIG. 6, and may be one or more other than 36.

3-8. Eighth Modification

In the above-described embodiment, the supporting member 4 has the holders 41, the fixing plates 42 and the base 43, but any one of the holders 41, the fixing plates 42, and the base 43 may be omitted. The flow channel unit 400 includes the flow channel structure 40 and the supporting member 4, but one of the flow channel structure 40 and the supporting member 4 may be omitted. In the above-described embodiment, the flow channel unit 400 includes the plurality of components, but the flow channel unit 400 may be a single component. For example, when the supporting member 4 is omitted, the head chips 3 may be fixed to the flow channel structure 40. The head unit 10 may omit the flow channel unit 400. For example, the flow channel unit 400 may be disposed outside the cover 70.

3-9. Ninth Modification

As previously described, the selection circuit 302 selects to supply or not to supply a drive signal Com to a piezoelectric element 34 in accordance with a print signal SI, and the like, and the selection circuit 302 may include a switch other than the transfer gates. The selection circuit 302 may include, for example, a transistor that functions as a switch. Furthermore, the selection circuit 302 is disposed on the protection plate 35. The selection circuit 302 may not be in contact with the protection plate 35 as long as the selection circuit 302 is disposed on the protection plate 35, and may be disposed on the protection plate 35 via another element.

3-10. Tenth Modification

In the above-described embodiment, the supporting member 4 is used as the "thermal conductor". The "thermal conductor" may not include, for example, the function of supporting the head chips 3. The "thermal conductor" may not have the flow channel. The supporting member 4 may be omitted and a "thermal conductor" that has high thermal conductivity may be disposed between the head chips 3 and the heat sink 60.

3-11. Eleventh Modification

In the above-described embodiment, the number of fans 80 is two, but may be one or three or more. The arrangement of the fans 80 is not limited to the example arrangement illustrated in FIG. 5. For example, the fans 80 may be disposed inside the cover 70. The head unit 10 may omit the fans 80.

3-12. Twelfth Modification

In the above-described embodiment, the first inlets 701, the second inlets 702, and the outlets 703 are disposed, but the number of the first inlets 701, the second inlets 702, and the outlets 703 may be one respectively. However, the outlets 703 disposed at several locations contribute to uniform temperature distribution in the space S. The same applies to the first inlets 701 and the second inlets 702. The first inlets 701 or the second inlets 702 may be omitted. The head unit 10 may not include the cover 70.

3-13. Thirteenth Modification

In the above-described embodiment, the number of heat sink 60 is one, but may be two or more. The arrangement of the heat sink 60 is not limited to the example arrangement illustrated in FIG. 5. For example, the heat sink 60 may be disposed on the side the circuit boards 50 are disposed with respect to the head chips 3.

While the present disclosure has been described with reference to the embodiment and modifications, it is to be understood that the present disclosure is not limited to the above-described embodiment and the modifications. The components in the structures in the disclosure may be replaced with any structure that achieves functions similar to the functions according to the above-described embodiment, or a structure may be added.

What is claimed is:

1. A head unit comprising:

piezoelectric elements configured to be driven in accordance with a drive signal to discharge liquid from nozzles;

a protection plate protecting the piezoelectric elements;

a head chip including a selection circuit disposed on the protection plate, the selection circuit being configured to select to supply or not to supply the drive signal to the piezoelectric elements;

a heat sink;

a thermal conductor coupling the head chip and the heat sink; and a plurality of the head chips including a first head chip and a second head chip, wherein the first head chip and the second head chip have a wiring member configured to supply the drive signal to the selection circuit, the first head chip and the second head chip are arranged in an intersecting direction intersecting the direction toward which the nozzles discharge the liquid, and the wiring member disposed on the first head chip and the wiring member disposed on the second head chip are arranged along the intersecting direction.

2. The head unit according to claim 1, further comprising:

a circuit board, wherein when viewed from a direction the nozzles discharge the liquid, the head chip is disposed between the circuit board and the heat sink.

3. The head unit according to claim 2, wherein the circuit board has a drive-signal generation circuit configured to generate the drive signal.

4. The head unit according to claim 1, further comprising:

a cover accommodating a part or all of the head chips and a part or all of the heat sink; and a fan configured to move air between the cover and the head chips and the heat sink.

5. The head unit according to claim 1, wherein the head chip has 1,000 or more nozzles, and the 1,000 or more nozzles are arranged with a pitch of 500 dpi or more.

6. A liquid discharging apparatus comprising:

the head unit according to claim 1; and a control unit configured to control the head unit.

7. A head unit comprising:

piezoelectric elements configured to be driven in accordance with a drive signal to discharge liquid from nozzles;

a protection plate protecting the piezoelectric elements;

a head chip including a selection circuit disposed on the protection plate, the selection circuit being configured to select to supply or not to supply the drive signal to the piezoelectric elements;

a heat sink;

a thermal conductor coupling the head chip and the heat sink;

a cover accommodating a part or all of the head chips and a part or all of the heat sink; and a fan configured to move air between the cover and the head chips and the heat sink.

8. A head unit comprising:

piezoelectric elements configured to be driven in accordance with a drive signal to discharge liquid from nozzles;

a protection plate protecting the piezoelectric elements;

a head chip including a selection circuit disposed on the protection plate, the selection circuit being configured to select to supply or not to supply the drive signal to the piezoelectric elements;

a heat sink; and a thermal conductor coupling the head chip and the heat sink, wherein the head chip has 1,000 or more nozzles, and the 1,000 or more nozzles are arranged with a pitch of 500 dpi or more.

* * * * *